US007035574B2

(12) United States Patent
Deguchi et al.

(10) Patent No.: US 7,035,574 B2
(45) Date of Patent: Apr. 25, 2006

(54) DEVELOPER CONTAINER AND IMAGE FORMING APPARATUS

(75) Inventors: Masanobu Deguchi, Kashiba (JP); Kazuya Koyama, Ikoma (JP); Shigeki Hayashi, Nara (JP); Hitoshi Nagahama, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 34 days.

(21) Appl. No.: 10/855,644

(22) Filed: May 28, 2004

(65) Prior Publication Data

US 2004/0240908 A1 Dec. 2, 2004

(30) Foreign Application Priority Data

May 28, 2003 (JP) ..... P2003-151335

(51) Int. Cl.
*G03G 15/08* (2006.01)

(52) U.S. Cl. ..... 399/262; 399/119; 399/120; 222/DIG. 1

(58) Field of Classification Search ..... 399/262, 399/120, 119, 98, 99
See application file for complete search history.

(56) References Cited

U.S. PATENT DOCUMENTS

| | | | | |
|---|---|---|---|---|
| 4,013,354 | A * | 3/1977 | Komori et al. | 399/99 |
| 5,455,662 | A | 10/1995 | Ichikawa et al. | |
| 5,500,719 | A | 3/1996 | Ichikawa et al. | |
| 5,627,631 | A | 5/1997 | Ichikawa et al. | |
| 5,822,663 | A | 10/1998 | Ichikawa et al. | |
| 5,918,090 | A | 6/1999 | Ichikawa et al. | |
| 6,075,963 | A | 6/2000 | Ichikawa et al. | |
| 6,137,972 | A * | 10/2000 | Playfair et al. | 399/106 |
| 6,141,520 | A * | 10/2000 | Kosuge | 399/262 |
| 6,289,195 | B1 | 9/2001 | Ichikawa et al. | |
| 6,418,293 | B1 | 7/2002 | Ichikawa et al. | |
| 2003/0138273 | A1 | 7/2003 | Ichikawa et al. | |
| 2004/0033087 | A1 * | 2/2004 | Yoshikawa et al. | 399/258 |

FOREIGN PATENT DOCUMENTS

| | | | |
|---|---|---|---|
| JP | 6-102758 | A | 4/1994 |
| JP | 6-348127 | A | 12/1994 |
| JP | 7-20705 | A | 1/1995 |
| JP | 8-339115 | A | 12/1996 |

* cited by examiner

*Primary Examiner*—David M. Gray
*Assistant Examiner*—Laura K. Roth
(74) *Attorney, Agent, or Firm*—Nixon & Vanderhye, P.C.

(57) ABSTRACT

A developer container includes a container body, a supporting member, a leading-out member and a spring member. The container body has a first concavity and a discharge hole. The container body is rotated about its axis to convey developer toward the discharge hole. The supporting member supports the container body rotatably about its axis by covering the part including the first concavity and the discharge hole. The supporting member has a leading through hole for leading developer from discharge hole to outside. The leading-out member extends from the leading through hole on an upstream side in the rotation direction. The leading-out member leads developer from the discharge hole to the leading through hole. The spring member loads the leading-out member with a resilient force that tends to bring its upstream side end in the rotation direction into elastic contact with the outer peripheral surface of the first concavity.

5 Claims, 30 Drawing Sheets

DEVELOPER CONTAINER AND IMAGE FORMING APPARATUS

BACKGROUND OF THE INVENTION

1. Field of the Invention

The present invention relates to a toner container for containing toner for use in electrophotographic system-based image formation, and to an image forming apparatus in which the toner container is detachably and attachably mounted.

2. Description of the Related Art

FIG. 30 is a perspective view showing a prior art developer supply container. In prior art such as Japanese Unexamined Patent Publication JP-A 8-339115 (1996), the developer supply container 1 is formed in a shape of a cylinder closed at both ends, and is provided with a space for containing toner. The developer supply container 1 has a first projection piece 4 and a second projection piece 6. The first projection piece 4 is so formed as to protrude inward in a radial direction, and to extend in a spiral fashion about an axis L1 from one axial end portion 2 to an axially central portion 3. The second projection piece 6 is so formed as to protrude inward in the radial direction, and to extend in a spiral fashion about the axis L1 from another axial end portion 5 to the axially central portion 3. Moreover, the developer supply container 1 has, in its axially central portion 3, a through hole 7 pierced radially for providing communication between the containing space and the space outside the developer supply container 1.

The developer supply container 1 is coupled to an image forming apparatus main body (not shown) in such a way that the axis L1 is parallel with the horizontal direction, and that the axially central portion 3 faces a toner supply port which is formed in the image forming apparatus main body so as to open upwardly. In this state, the developer supply container 1 is rotated about the axis L1 by driving force of a driving section disposed in the image forming apparatus main body. Thereby, the toner contained in the containing space of the developer supply container 1 is fed to the axially central portion 3 by the projection pieces 4 and 6. At the instant when the through hole 7 is placed in a position facing the toner supply port, the toner is fed through the through hole 7 to the toner supply port.

FIG. 31 is a perspective view showing a second prior art toner cartridge 10, such as that of Japanese Unexamined Patent Publication JP-A 6-348127 (1994). The toner cartridge 10 has the shape of a cylinder closed at both ends, with a space formed in it for containing toner. The toner cartridge 10 has, in its axially central portion 11, a through hole 12 which axially extends and is pierced radially for providing communication between the containing space and the space outside the toner cartridge 10.

The toner cartridge 10 is coupled to an image forming apparatus main body (not shown) in such a way that the axis L10 is parallel with the horizontal direction, and that the axially central portion faces a toner supply port which is formed in the image forming apparatus main body so as to open upwardly. In this state, the toner cartridge 10 is rotated about the axis L10 by driving force of a driving section disposed in the image forming apparatus main body. At the instant when the through hole 12 is placed in a position facing the toner supply port, the toner contained in the containing space of the toner cartridge 10 is fed through the through hole 12 to the toner supply port.

However, in the prior art concerning the developer supply containers 1 and 10, there is no disclosure or suggestion as to directing the developer discharged from the developer supply container to a desired position.

BRIEF SUMMARY

A developer container is provided in which developer discharged from a discharge hole into a concavity is completely scraped up and is then directed to a leading through hole. An image forming apparatus is also provided in which the developer container is detachably and attachably mounted.

A developer container designed to be detachably and attachably mounted in an image forming apparatus, comprises:

a container main body, formed in a cylindrical shape, for containing therein developer for use in image formation, the container main body having, about its outer periphery, a concavity which is sunk inward in a radial direction and a discharge hole for discharging developer into the concavity, the container main body being rotated about its axis to convey the developer contained therein toward the discharge hole;

a supporting member for supporting the container main body rotatably about its axis by covering a part of the container main body which part includes at least the concavity and the discharge hole, from its outer side in the radial direction over its entire circumference, the supporting member having a leading through hole formed so as to face a path along which the concavity is moved in accompaniment with a rotation of the container main body, for leading the developer discharged from the discharge hole to outside;

a leading-out member, formed in a sheet-like shape and extending from the leading through hole on an upstream side in a rotation direction, for leading the developer discharged from the discharge hole of the container main body to the leading through hole; and resilient-force generating means for loading the leading-out member with a resilient force that tends to bring an upstream side end in the rotation direction of the leading-out member into resilient contact with an outer peripheral surface of the concavity in the container main body.

As the container main body is rotated about its axis, the developer contained therein is conveyed toward the discharge hole, and is then discharged from the discharge hole into the concavity. Since the part of the container main body which part includes at least the concavity and the discharge hole is covered by the supporting member, from the outer side in the radial direction over the entire circumference, the developer discharged from the discharge hole into the concavity is retained in a space facing the concavity and the inner periphery of the supporting member. Moreover, the leading-out member is loaded by the resilient-force generating means with a resilient force that tends to bring its upstream side end in the rotation direction into resilient contact with the outer peripheral surface of the concavity in the container main body. Thus, as the container main body is rotated about its axis, the developer retained in the space is scraped off the outer peripheral surface of the concavity and is then directed to the leading through hole. The developer that is thus directed to the leading through hole is then directed therefrom to the outside. Since the leading-out member is shaped like a sheet, there is a possibility that it is plastically deformed when brought in contact with the outer peripheral surface of the container main body rotating about its axis. However, even though plastic deformation occurs, since the leading-out member is loaded by the resilient-force generating means with a resilient force that tends to bring its upstream side end in the rotation direction into resilient contact with the outer peripheral surface of the concavity in the container main body, the upstream side end in the rotation direction of the leading-out member is allowed to abut resiliently against the outer peripheral surface of the concavity in the container main body without fail. As a result, the developer retained in the space is scraped off the outer peripheral surface of the concavity and is then directed to the leading through hole.

The upstream side end in the rotation direction of the leading-out member is flexible and resilient.

Being flexible and resilient, the upstream side end in the rotation direction of the leading-out member is allowed to abut resiliently against the outer peripheral surface of the concavity in the container main body rotating about its axis under a uniform resilient force. As a result, as the container main body is rotated about its axis, almost all of the developer retained in the space is scraped off the outer peripheral surface of the concavity and is then directed to the leading through hole.

The developer container further comprises a deformation preventive member for preventing plastic deformation of a midsection of the leading-out member, the midsection lying between both ends in the rotation direction of the leading-out member, and the leading-out member is flexible and resilient.

The leading-out member is flexible and resilient, and the deformation preventive member prevents plastic deformation of the midsection lying between both ends in the rotation direction of the leading-out member. Thus, it never occurs that the midsection lying between both ends in the rotation direction of the leading-out member is plastically deformed when brought in contact with the outer peripheral surface of the container main body rotating about its axis. Moreover, in the leading-out member, at least its upstream side end in the rotation direction is flexible and resilient. This allows the upstream side end in the rotation direction of the leading-out member to abut resiliently against the outer peripheral surface of the concavity in the container main body rotating about its axis under a uniform resilient force. As a result, as the container main body is rotated about its axis, almost all of the developer retained in the space created face to face with the concavity of the container main body and the inner periphery of the supporting member is scraped off the outer peripheral surface of the concavity and is then directed to the leading through hole.

The leading-out member has guide walls which are formed at both axial ends thereof and protrude outward in the radial direction.

Since the leading-out member has the guide walls which are formed at both axial ends and protrude outward in the radial direction, the developer to be directed to the leading through hole can be prevented from being directed to any other position than the leading through hole. As a result, the developer can be directed to the leading through hole without fail.

An image forming apparatus has the developer container mentioned above detachably and attachably mounted.

The image forming apparatus is designed to detachably and attachably receive therein the developer container that has succeeded in offering the advantageous effects as described heretofore.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
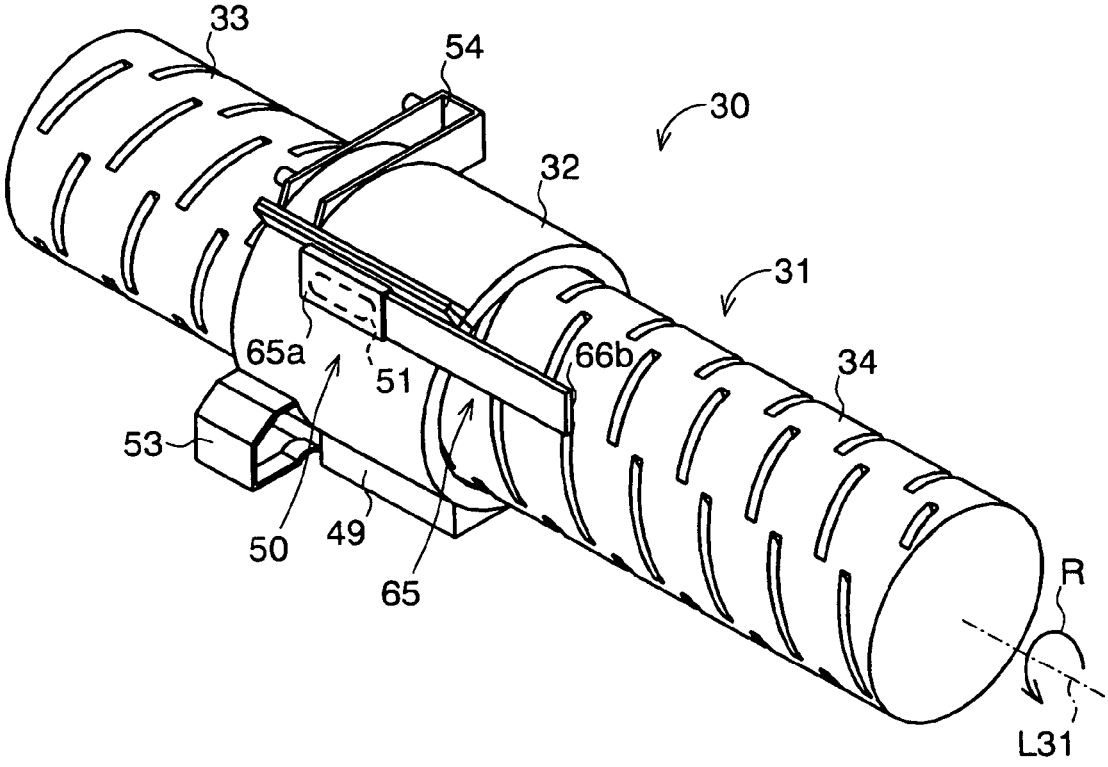
FIG. 1 is a perspective view showing a developer container according to one embodiment of the invention.

Now referring to the drawings, preferred embodiments of the invention are described below.

Figure 2:
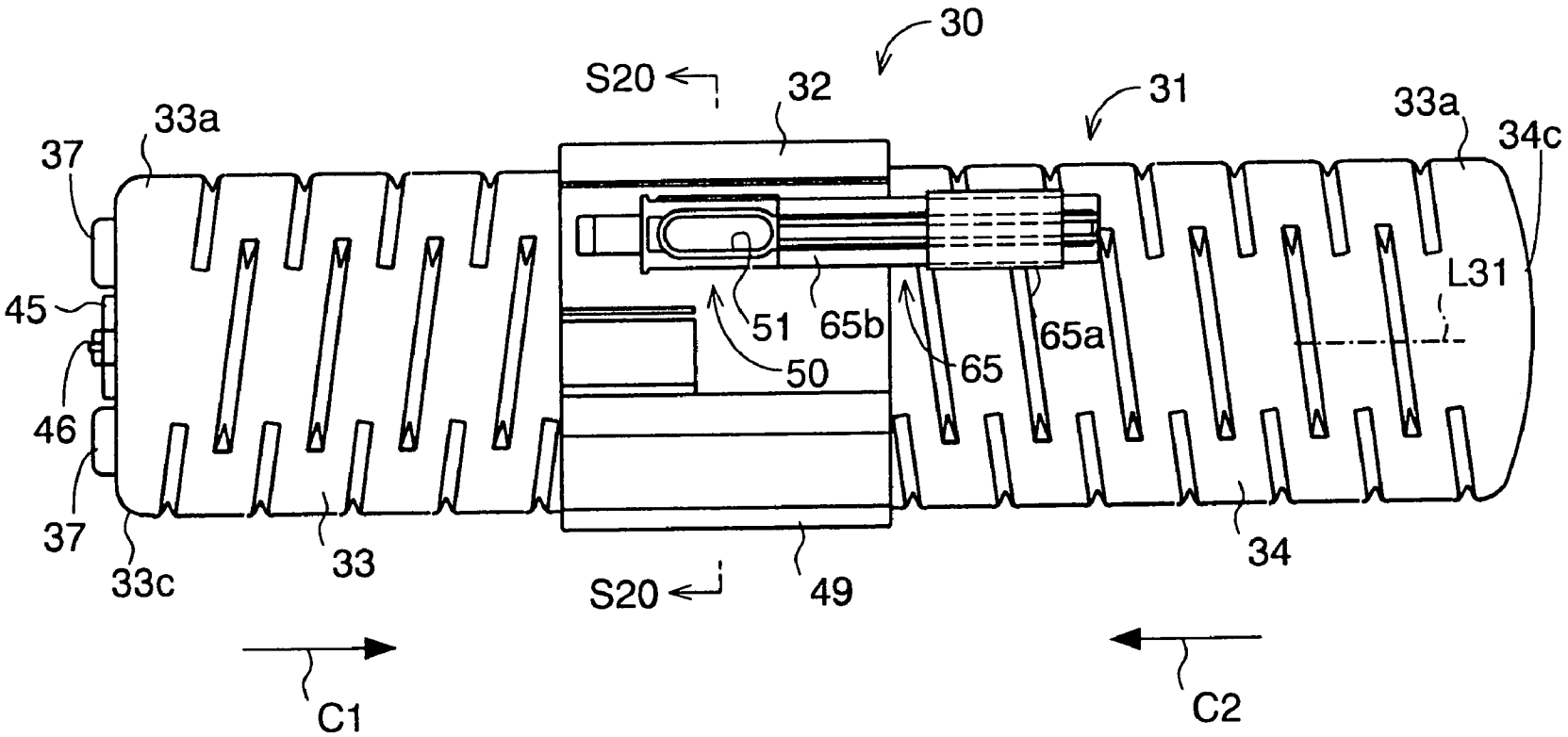
FIG. 2 is a front view showing the developer container.
Figure 3:
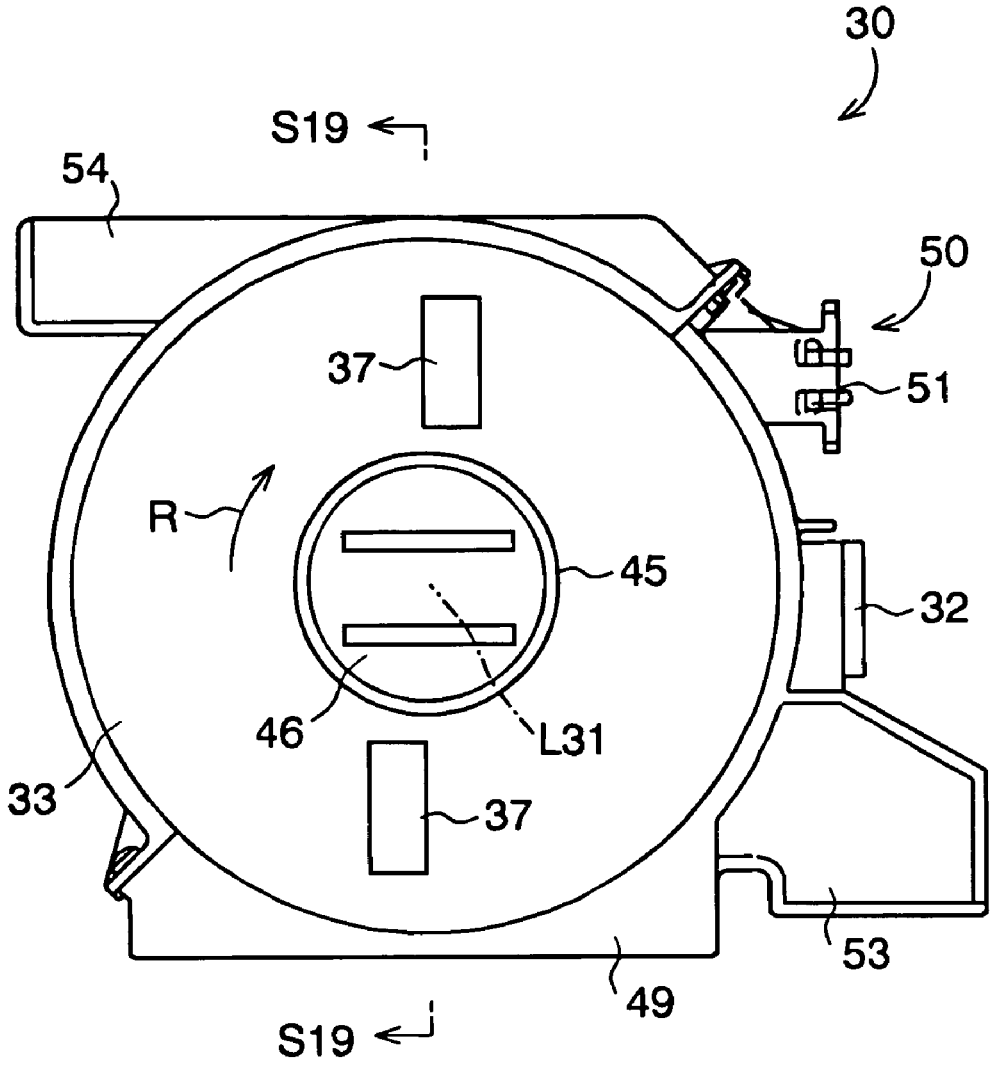
FIG. 3 is a left-hand side view showing the developer container.

FIG. 1 is a perspective view showing a developer container 30 according to one embodiment of the invention. FIG. 2 is a front view showing the developer container 30. FIG. 3 is a left-hand side view showing the developer container 30. The developer container 30 includes a container main body 31 and a supporting member 32. The container main body 31, which has substantially a cylindrical shape, is designed to contain developer such as coloring toner for use in electrophotographic system-based image formation. The supporting member 32 supports the container main body 31 in such a way that the container main body 31 is rotatable about its axis L31. The developer container 30 is capable of containing, for example, 1400 grams of developer. Hereinafter, the axis L31 of the container main body 31 is also referred to as the "rotation axis L31".

Figure 4:
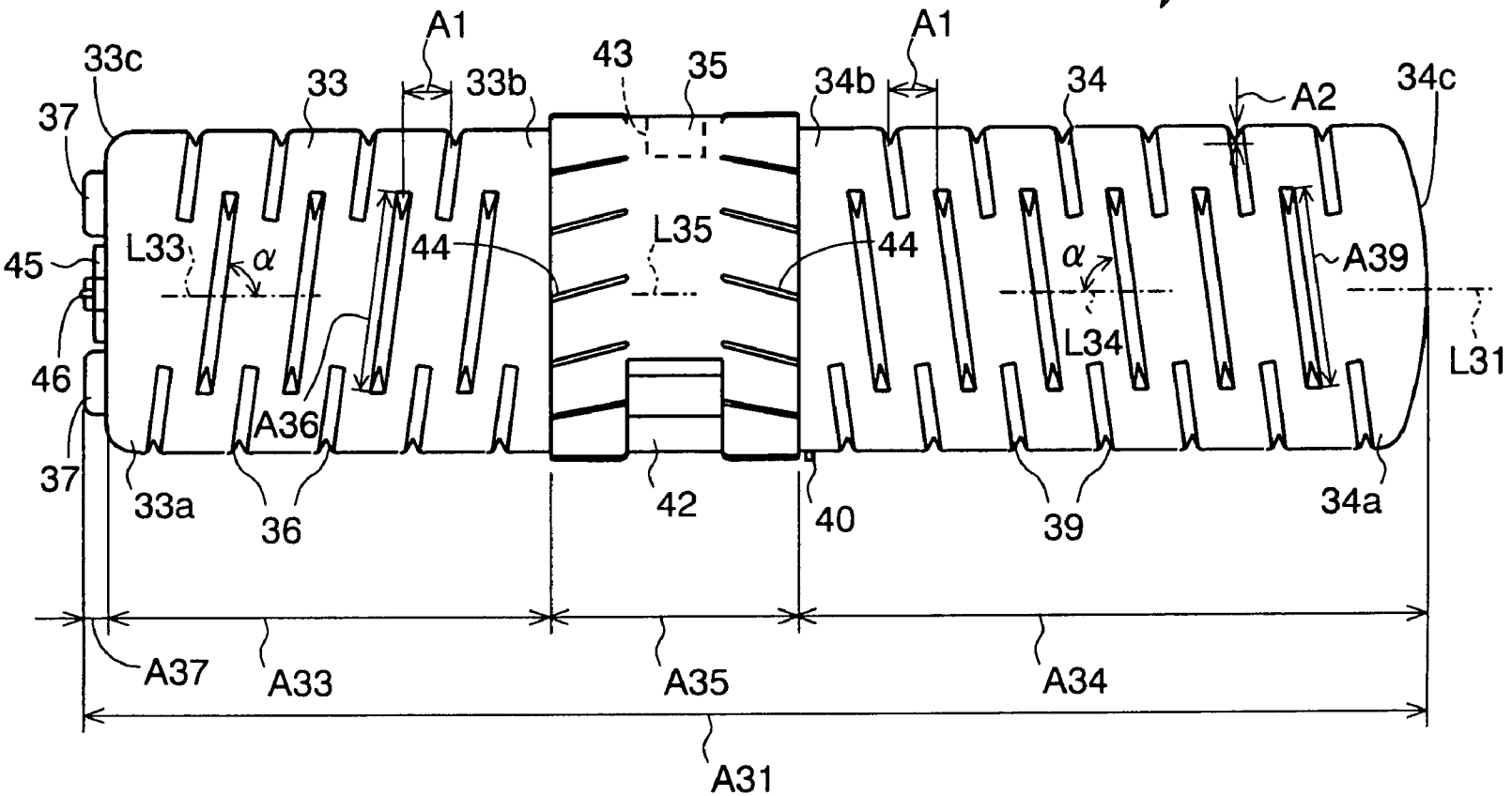
FIG. 4 is a front view showing a container main body.
Figure 5:
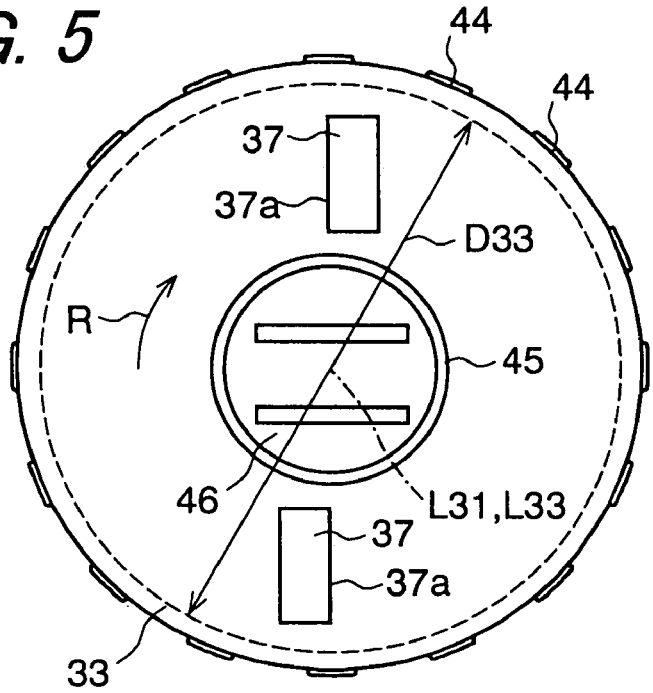
FIG. 5 is a left-hand side view showing the container main body.
Figure 6:
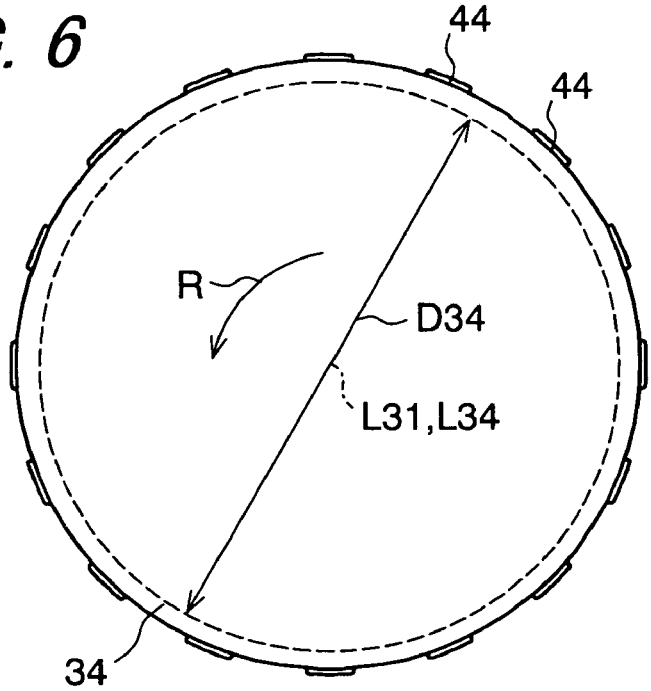
FIG. 6 is a right-hand side view showing the container main body.

FIG. 4 is a front view showing the container main body 31. FIG. 5 is a left-hand side view showing the container main body 31. FIG. 6 is a right-hand side view showing the container main body 31. The container main body 31 includes a first container segment 33, a second container segment 34, and a third container segment 35. In the container main body 31, its length measurement A31 in a direction of the axis L31 may be arbitrarily determined, for example, it is preferably set at 458 mm.

The first container segment 33 is given the shape of a bottomed cylinder. In the first container segment 33, its axial length measurement A33 may be arbitrarily determined, for example, it is preferably set at 160 mm. The first container segment 33 has, in its inner periphery, feeding means for feeding developer in the axial direction when driven to rotate about the axis L31. As shown in FIG. 4, the feeding means has a plurality of first projection pieces 36 serving as feeding portions. The first projection piece 36 is so formed as to extend along a first extending direction transversely across the circumferential direction, and to protrude inward in a radial direction. The first projection pieces 36 are spaced apart in the circumferential and axial directions. Specifically, each of the first projection piece 36 extends inclinedly in a circular arc shape, with its downstream side end in a rotation direction placed in a position on a bottom portion 33*a* side as compared to its upstream side end in the rotation direction.

As shown in FIGS. 4 and 5, on the bottom portion 33*a* of the first container segment 33 are formed a convex fit 37 and a replenishment port 45. The convex fit 37, acting as a coupling portion, protrudes from an opening end 33*b* to the bottom portion 33*a*. The convex fit 37 is formed in plural, in this embodiment, in a total number of two. The replenishment port 45 is formed at the center of the bottom portion 33*a* of the first container segment 33 so as to penetrate in the direction of the rotation axis L31, and to open in the shape of a circle which is coaxial with the axis L33 of the first container segment 33. Detachably attached to the replenishment port 45 is a replenishment lid 46 which is configured in accordance with the shape of the replenishment port 45. The replenishment lid 46 is so designed that, while being kept attached to the replenishment port 45 to provide a seal therebetween, it is prevented from falling off because of the rotation of the container main body 31. By detaching the replenishment lid 46 from the replenishment port 45, the inner space of the container main body 31 communicates with the outside space, whereby making it possible to replenish the container main body 31 with developer.

Specifically, the convex fits 37 are located outward in the radial direction in contrast to the replenishment port 45, and arranged at a roughly mutually symmetrical position with respect to the axis L33 of the first container segment 33. More specifically, as shown in FIG. 5, the convex fit 37 is so configured that its portion 37*a* on the upstream side in the rotation direction R has a plane extending vertically in the circumferential direction. Here, the rotation direction R refers to the direction in which rotation is made clockwise about the rotation axis L31, when viewed from the bottom portion 33*a* of the first container segment 33. Moreover, the convex fit 37 is so configured that its portion on the downstream side in the rotation direction R is gradually inclined toward the other axial end from the upstream side to the downstream side in the rotation direction R. Here, a jutting amount A37 by which the convex fit 37 juts in the direction of the axis L33 from the rest part of the bottom portion 33*a* may be arbitrarily determined. For example, it is preferably set at 8 mm. The convex fit 37 such as shown herein is made attachable to and detachable from a main body-side coupling section 83 provided in an image forming apparatus 70, which will be described later (refer to FIG. 29).

Moreover, in the first container segment 33, the bottom portion 33*a* has a face 33*c* which is defined by the juncture of the outer peripheral surface with the end face thereof. As shown in FIG. 4, the face 33*c* is shaped as a curved plane gradually inclined inward in the radial direction from the opening end 33*b* side to the bottom portion 33*a* side.

The second container segment 34 is given the shape of a bottomed cylinder. In the second container segment 34, its axial length measurement A34 may be arbitrarily determined, for example, it is preferably set at 210 mm. The second container segment 34 has, in its inner periphery, feeding means for feeding developer in the axial direction when driven to rotate about the axis L31. As shown in FIG. 4, the feeding means has a plurality of second projection pieces 39 serving as feeding portions. The second projection piece 39 is so formed as to extend along a second extending direction which differs from the first extending direction transversely across the circumferential direction, and to protrude inward in the radial direction. Each of the second projection pieces 39 are spaced apart in the circumferential and axial directions. Specifically, each of the second projection piece 39 extends inclinedly in a circular arc shape, with its downstream side end in the rotation direction placed in a position on a bottom portion 34*a* side as compared to its upstream side end in the rotation direction.

In the second container segment 34, its axial length measurement A34 is adjusted to be longer than the axial length measurement A33 of the first container segment 33. For example, the axial length measurement A34 is preferably set to be 30 mm or more longer than the axial length measurement A33. As described previously, the axial length measurement A33 of the first container segment 33 may be arbitrarily determined, for example, it is preferably set at 150 mm. Likewise, the axial length measurement A34 of the second container segment 34 may be arbitrarily determined, for example, it is preferably set at 215 mm. Moreover, an internal diameter D33 of the inner periphery part of the first container segment 33 excluding the first projection pieces 36, as well as an internal diameter D34 of the inner periphery part of the second container segment 34 excluding the second projection pieces 39, may be arbitrarily determined, for example, it is preferably set at 105 mm. Further, an interval A1 between a pair of the first projection pieces 36 (a pair of second projection pieces 39) which are adjacent to each other in the axial direction may be arbitrarily determined, for example, it is preferably set at 15 mm.

A length measurement A36 of the first projection piece 36 in the first extending direction (a length measurement A39 of the second projection piece 39 in the second extending direction) should preferably fall in a range approximately from 1/16 to 3/8 of the inner periphery length of the first container segment 33 (the inner periphery length of the second container segment 34). In case where the length measurement A36 of the first projection piece 36 in the first extending direction (the length measurement A39 of the second projection piece 39 in the second extending direction) is shorter than 1/16 of the inner periphery length of the first container segment 33 (the inner periphery length of the second container segment 34), the developer feeding capability is decreased. By contrast, in case where the length measurement A36 of the first projection piece 36 in the first extending direction (the length measurement A39 of the second projection piece 39 in the second extending direction) is longer than 3/8 of the inner periphery length of the first container segment 33 (the inner periphery length of the second container segment 34), the mechanical strength of the container main body 31 is undesirably decreased. Moreover, in case where the feeding capability of the first and second projection pieces 36 and 39 is unduly high, the possibility arises that developer will be coagulated in the vicinity of the discharge hole. In this embodiment, the length measurement A36 of the first projection piece 36 in the first extending direction, as well as the length measurement A39 of the second projection piece 39 in the second extending direction, may be arbitrarily determined, for example, it is preferably set at 60 mm. Further, the interval between the two first projection pieces 36 which are adjacent to each other in the circumferential direction, as well as the interval between the two second projection pieces 39 which are adjacent to each other in the circumferential direction, may be arbitrarily determined, for example, it is preferably set at 50 mm.

Moreover, a jutting amount A2 by which the first projection piece 36 (the second projection piece 39) juts radially inward from the rest inner periphery part of the first container segment 33 (the second container segment 34) should preferably fall in a range approximately from 1 mm to 10 mm. In case where the jutting amount A2 is greater than 10 mm, the developer feeding capability of the first and second projection pieces 36 and 39 can be enhanced, but excessive enhancement of the feeding capability may possibly lead to occurrence of developer coagulation in the vicinity of the discharge hole. In addition, the jutting amount A2 exceeding 10 mm gives rise to a problem of forming the first and second projection pieces 36 and 39 by blow molding being difficult. By contrast, in case where the jutting amount A2 is less than 1 mm, the developer feeding capability is so low that it is impossible to feed a sufficient quantity of developer into the discharge hole. In this embodiment, for example, the jutting amount A2 by which the first projection piece 36 (the second projection piece 39) juts inward in the radial direction from the rest inner periphery part of the container segment is preferably set at 6 mm. Note that, the larger the number of the first and second projection pieces 36 and 39, the higher the feeding capability. Thus, in this embodiment, the first projection piece 36 is preferably formed in a total number of twenty six, whereas the second projection piece 39 is preferably formed in a total number of thirty eight.

Further, an angle $\alpha$ which is formed between a tangential line of the first projection piece 36 (the second projection piece 39) and a circumferentially tangential line of the first container segment 33 (the second container segment 34), should preferably fall in a range from 2 to 45 degrees, more preferably, 5 to 30 degrees. In this embodiment, for example, the angle $\alpha$ is preferably set at approximately 9 degrees. The developer feeding capability of the container main body 31 is determined, in accordance with the above stated geometrical conditions of the first and second projection pieces 36 and 39, so that developer can be constantly discharged in an appropriate quantity from a discharge hole 43, from the time the container main body 31 is full of developer until the developer reaches the verge of running out.

In the second container segment 34, its bottom portion 34*a* has a face which is defined by the juncture of the outer peripheral surface with the end face thereof. At least this face is shaped as a curved plane gradually inclined inward in the radial direction from the opening end 34*b* side to the bottom portion 34*a* side. Specifically, the end face 34*c* of the bottom portion 34*a* of the second container segment 34 is shaped into a partly spherical plane whose center protrudes from the opening end 34*b* side to the bottom portion 34*a* side. Moreover, the second container segment 34 has, in its outer periphery, a guide projection piece 40 formed at a distance from the end face of the opening end 34*b*, toward the bottom portion 34*a* side, so as to protrude outward in the radial direction. The guide projection piece 40 is formed in plural (two pieces, in this embodiment), and they are spaced apart in the circumferential direction. The axial dimension of the guide projection piece 40 may be arbitrarily determined, for example, it is preferably set at 2.5 mm.

Figure 7:
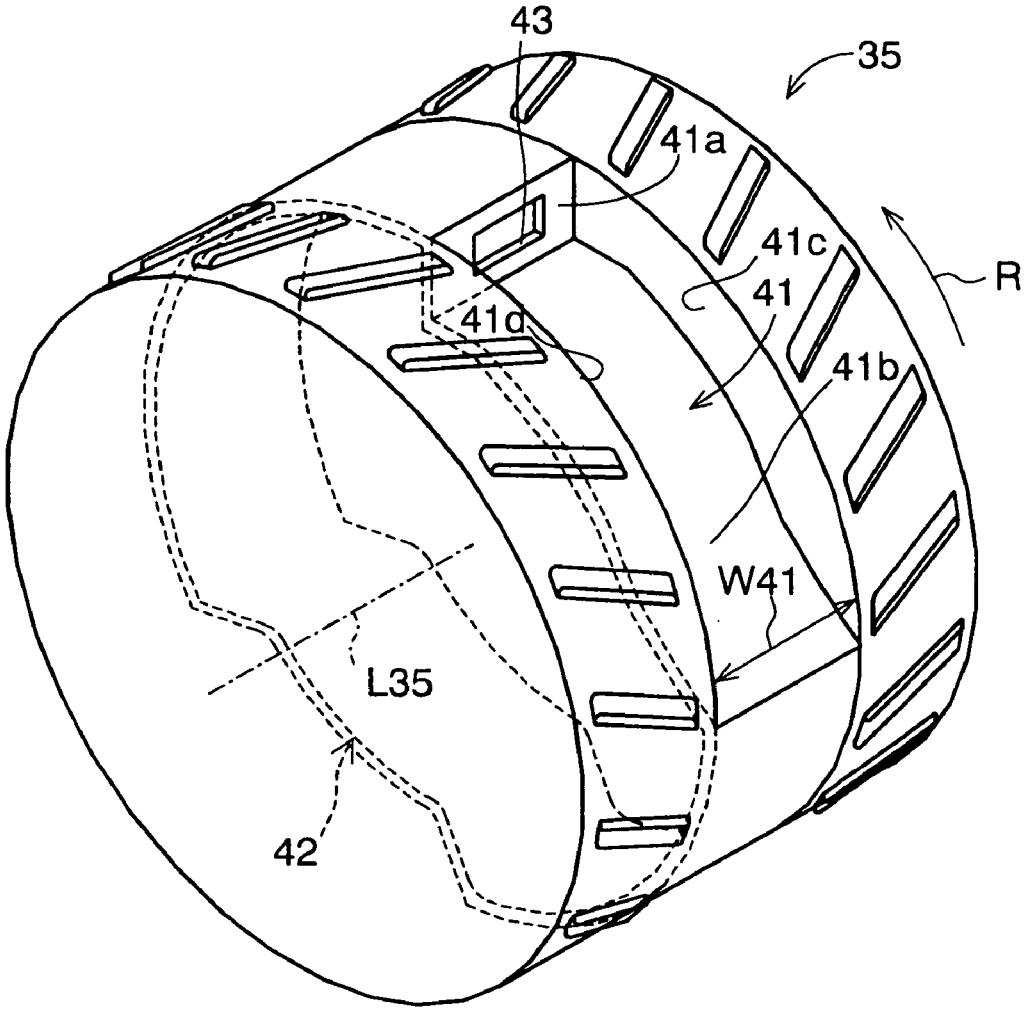
FIG. 7 is a perspective view showing a third container segment.
Figure 8:
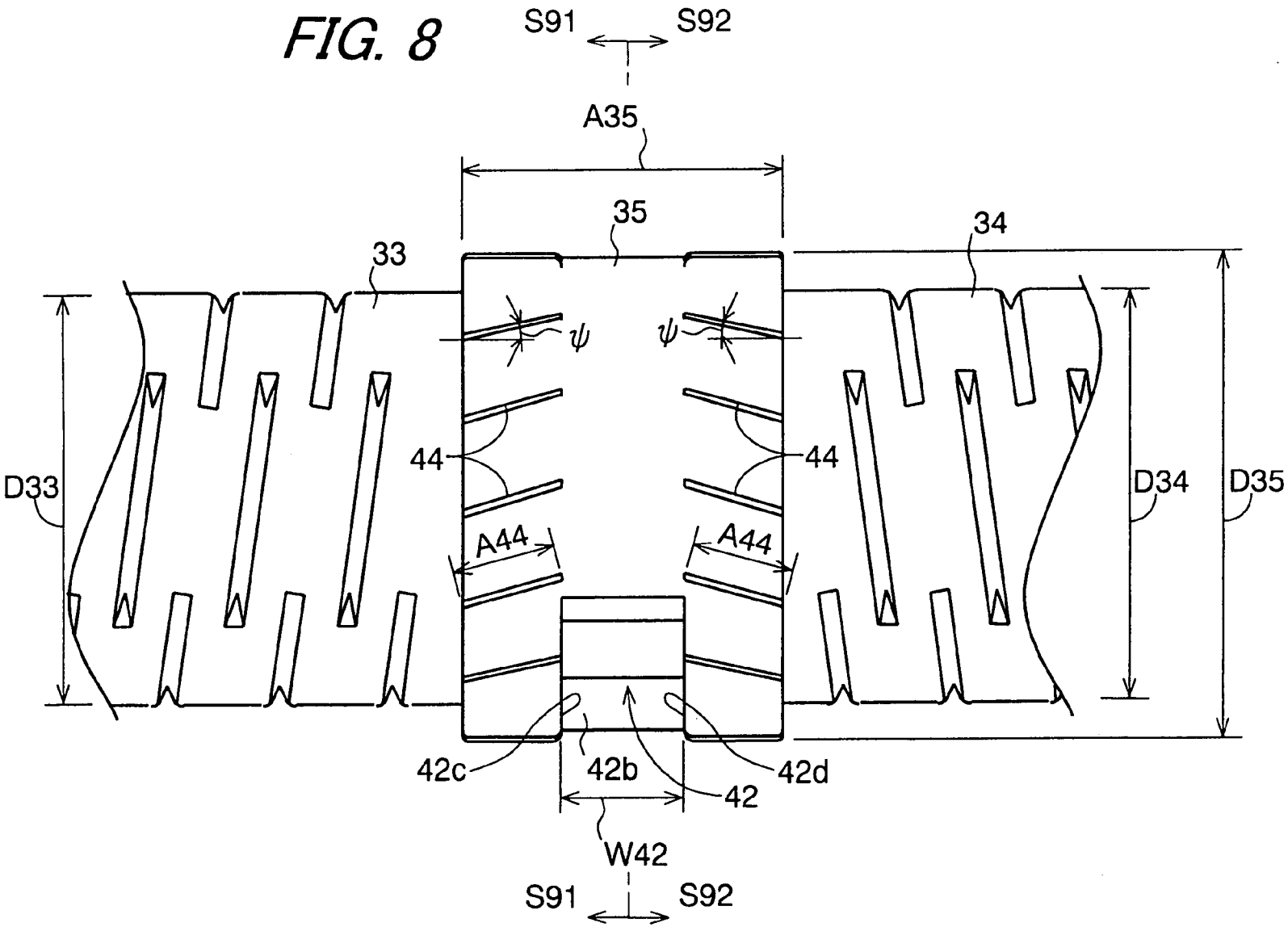
FIG. 8 is an enlarged front view showing the third container segment and other components in the vicinity.
Figure 9A:
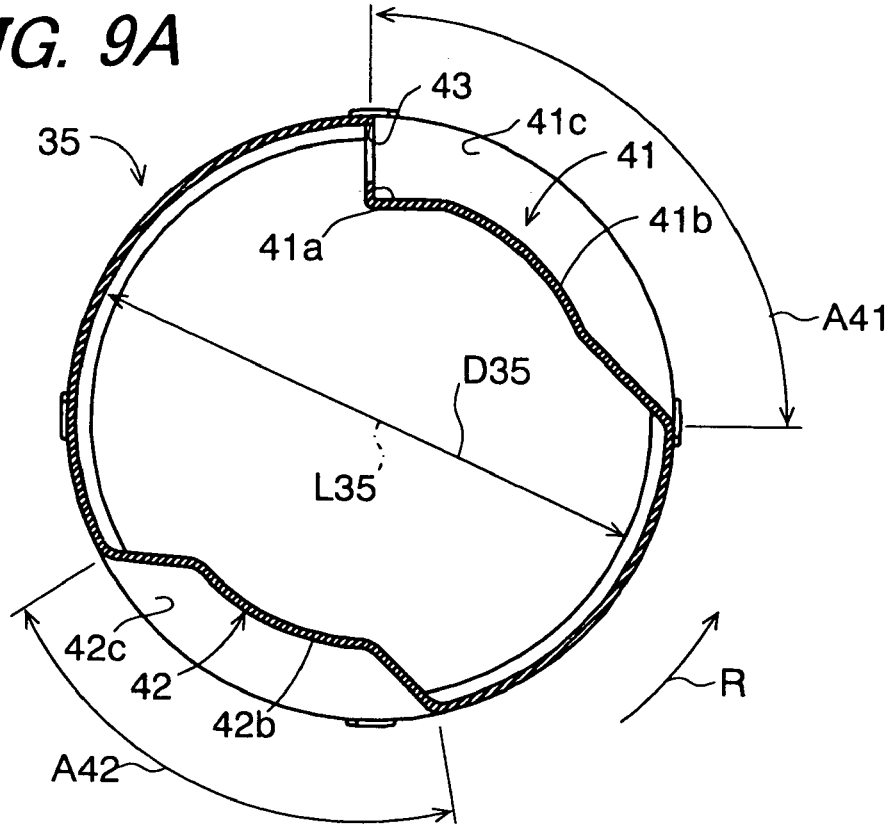
FIG. 9A is a sectional view taken along the line S91—S91 of FIG. 8.
Figure 9B:
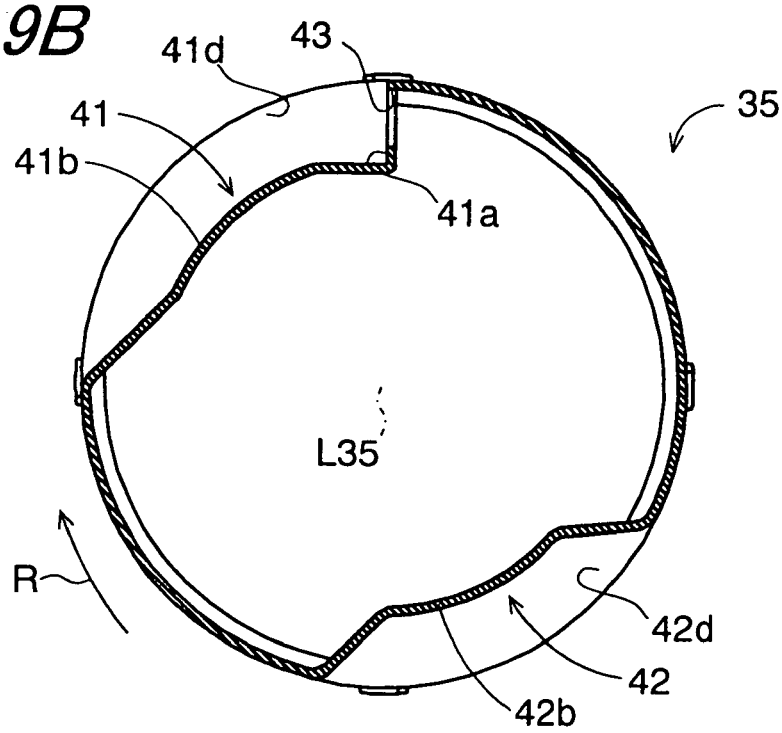
FIG. 9B is a sectional view taken along the line S92—S92 of FIG. 4.

FIG. 7 is a perspective view showing the third container segment 35. FIG. 8 is an enlarged front view showing the third container segment 35 and other components in the vicinity. FIG. 9A is a sectional view taken along the line S91—S91 of FIG. 8. FIG. 9B is a sectional view taken along the line S92—S92 of FIG. 4. Reference is now made also to FIG. 4. The third container segment 35 is given substantially a cylindrical shape. Specifically, the third container segment 35 has, in axially middle positions about its outer periphery, a first concavity 41 and a second concavity 42 formed so as to be sunk inward in the radial direction. The third container segment 35 has also the discharge hole 43 formed in the first concavity 41 for discharging developer. An axial length measurement A35 of the third container segment 35 is preferably set at 80 mm, for example. An internal diameter D35 of the third container segment 35 excluding the first and second concavities 41 and 42 is made longer than the internal diameter D33, D34 of the rest first, second container segment 33, 34. The internal diameter D35 of the third container segment 35 excluding the first and second concavities 41 and 42 may be arbitrarily determined, for example, it is preferably set at 110 mm.

The first concavity 41 is so formed as to extend along the rotation direction R, with its axial dimension W41 made smaller than its dimension A41 in the rotation direction R. The first concavity 41 has, at its downstream side end in the rotation direction R, an end wall portion 41*a* extending transversely across the rotation direction R. The discharge hole 43 is formed in part of the end wall portion 41*a* on the downstream side in the rotation direction of the first concavity 41. The second concavity 42 is so formed as to extend along the rotation direction R, with its axial dimension W42 made smaller than its dimension A42 in the rotation direction R. The second concavity 42 is formed at a distance from the first concavity 41 in the circumferential direction of the third container segment 35. The dimension A41 in the rotation direction R of the first concavity 41 should preferably fall in a range from ¼ to half of the outer periphery length of the third container segment 35 excluding the first and second concavities 41 and 42. In the first concavity 41, for example, the dimension A41 in the rotation direction R is preferably set at 120 mm, whereas the axial dimension W41 is preferably set at 30 mm. Meanwhile, in the second concavity 42, both the dimension A42 in the rotation direction R and the axial dimension W42 may be arbitrarily determined, for example, the former is preferably set at 120 mm, and the latter is preferably set at 30 mm.

Specifically, the first concavity 41 further includes a bottom wall portion 41*b*, a first side wall portion 41*c*, and a second side wall portion 41*d*. The bottom wall portion 41*b* of the first concavity 41 extends along the rotation direction R, with its downstream side end in the rotation direction R made continuous with a radially-inner part of the end wall portion 41*a*, and with its upstream side end in the rotation direction R made smoothly continuous with part of the outer periphery of the third container segment 35 excluding the first and second concavities 41 and 42, existing between the first and second concavities 41 and 42. In the bottom wall portion 41*b* of the first concavity 41, its midsection in the rotation direction R, lying between the downstream side end in the rotation direction R and the upstream side end in the rotation direction R, is placed inward in the radial direction as compared to the third container segment 35 excluding the first and second concavities 41 and 42. The midsection in the rotation direction R has substantially a part-cylindrical shape whose axis is defined by the axis L35 of the third container segment 35. In the bottom wall portion 41*b* of the first concavity 41, the radius of curvature of the outer periphery of the midsection in the rotation direction R may be arbitrarily determined, for example, it is preferably set at 49 mm.

In the first concavity 41, the first side wall portion 41*c* is arranged on one axial end side of the first concavity 41. The first side wall portion 41*c* extends along the rotation direction R, with its downstream side end in the rotation direction R made continuous with one axial end of the end wall portion 41*a*; with its radially-inner part made continuous with one axial end of the bottom wall portion 41*b*; and with its radially-outer part made continuous with the outer periphery of one axial end of the third container segment 35 excluding the first and second concavities 41 and 42. Moreover, in the first concavity 41, the second side wall portion 41*d* is arranged on the other axial end side of the first concavity 41. The second side wall portion 41*d* extends along the rotation direction R, with its downstream side end in the rotation direction R made continuous with the other axial end of the end wall portion 41*a*; with its radially-inner part made continuous with the other axial end of the bottom wall portion 41*b*; and with its radially-outer part made continuous with the outer periphery of the other axial end of the third container segment 35 excluding the first and second concavities 41 and 42. The first and second side wall portions 41*c* and 41*d* of the first concavity 41 are each so formed as to upstand outward in the radial direction from the bottom wall portion 41*b*. The first and second side wall portions 41*c* and 41*d* are each substantially perpendicular to the bottom wall portion 41*b*.

The discharge hole 43 is formed in the axially middle position of the end wall portion 41*a* of the first concavity 41 so as to be located outward in the radial direction. Moreover, the discharge hole 43 is shaped as a rectangular opening, the lengthwise direction of which is aligned with the axial direction. Thus, in the end wall portion 41*a* of the first concavity 41, the discharge hole 43 is so formed as to open radially outward as compared to the downstream side end in the rotation direction R of the bottom wall portion 41*b* of the first concavity 41; to open in the other axial end-ward position as compared to the downstream side end in the rotation direction R of the first side wall portion 41*c*; and to open in the one axial end-ward position as compared to the downstream side end in the rotation direction R of the second side wall portion 41*d*. More specifically, the discharge hole 43 has its radially-outer surface made smoothly continuous with a part of the inner peripheral surface of the third container segment 35 excluding the first and second concavities 41 and 42 which is located on the downstream side in the rotation direction R of the first concavity 41.

Specifically, the second concavity 42 further includes a bottom wall portion 42*b*, a first side wall portion 42*c*, and a second side wall portion 42*d*. The bottom wall portion 42*b* of the second concavity 42 extends along the rotation direction R, with its ends on the upstream and downstream sides in the rotation direction R made smoothly continuous with part of the outer periphery of the third container segment 35 excluding the first and second concavities 41 and 42, existing between the first and second concavities 41 and 42. In the bottom wall portion 42*b* of the second concavity 42, its midsection in the rotation direction R, lying between the downstream side end in the rotation direction R and the upstream side end in the rotation direction R, is placed inward in the radial direction as compared to the third container segment 35 excluding the first and second concavities 41 and 42. The midsection in the rotation direction R has substantially a part-cylindrical shape whose axis is defined by the axis L35 of the third container segment 35. In the bottom wall portion 42*b* of the second concavity 42, the radius of curvature of the outer periphery of the midsection in the rotation direction R may be arbitrarily determined, for example, it is preferably set at 49 mm.

In the second concavity 42, the first side wall portion 42*c* is arranged on one axial end side of the second concavity 42. The first side wall portion 42*c* extends along the rotation direction R, with its radially-inner part made continuous with one axial end of the bottom wall portion 42*b*, and with its radially-outer part made continuous with the outer periphery of one axial end of the third container segment 35 excluding the first and second concavities 41 and 42. Moreover, in the second concavity 42, the second side wall portion 42*d* is arranged on the other axial end side of the second concavity 42. The second side wall portion 42*d* has its radially-inner part made continuous with the other axial end of the bottom wall portion 42*b*, and its radially-outer part made continuous with the outer periphery of the other axial end of the third container segment 35 excluding the first and second concavities 41 and 42. The first and second side wall portions 42*c* and 42*d* of the second concavity 42 are each so formed as to upstand outward in the radial direction from the bottom wall portion 42*b*. The first and second side wall portions 42*c* and 42*d* are each substantially perpendicular to the bottom wall portion 42*b*.

As shown in FIG. 8, disposed about the outer periphery of each of one and the other axial ends of the third container segment 35 excluding the first and second concavities 41 and 42 are a plurality of discharge guide pieces 44 protruding outward in the radial direction. The discharge guide pieces 44 are evenly spaced in the circumferential direction. Specifically, the discharge guide piece 44 disposed at one axial end of the third container segment 35 is gradually inclined in the rotation direction R from the other axial end side to one axial end side. On the other hand, specifically, the discharge guide piece 44 disposed at the other axial end of the third container segment 35 is gradually inclined in the rotation direction R from one axial end side to the other axial end side. The jutting amount A44 by which the discharge guide piece 44 juts radially outward from the outer periphery of the third container segment 35 excluding the first and second concavities 41 and 42 is preferably set at 1 mm, for example. A dimension in a longitudinal direction of the discharge guide piece 44 is preferably set at 24 mm. An angle ψ which is formed between the longitudinal direction of the discharge guide piece 44 and a width direction of the third container segment 35 is preferably set at 30 degrees.

The container main body 31 is a combination of the first, second, and third container segments 33, 34, and 35 in one. That is, one axial end of the third container segment 35 is coupled to the opening end 33*b* of the first container segment 33, whereas the other axial end of the third container segment 35 is coupled to the opening end 34*b* of the second container segment 34. The container main body 31 such as shown herein is preferably produced by subjecting a synthetic resin material such as polyethylene to blow molding. In this way, the container main body 31 can be produced with ease. Another advantageous feature is that the number of the components constituting the developer container 30 can be reduced.

The bottom portion 33*a* of the first container segment 33 coincides with one axial end 33*a* of the container main body 31, and the bottom portion 34*a* of the second container segment 34 coincides with the other axial end 34*a* of the container main body 31. Thus, the first, second, and third container segments 33, 34, and 35 are coaxially coupled to one another, with their axes L33, L34, and L35 coinciding with one another, thereby constituting the container main body 31. Moreover, in this state, the third container segment 35 is arranged in the axially middle position of the container main body 31 excluding the axial ends 33*a* and 34*a*. Correspondingly, the first and second container concavities 41 and 42 and the discharge hole 43 of the third container segment 35 are arranged in the axially middle position of the container main body 31 excluding the axial ends 33*a* and 34*a*. The axis L31 of the container main body 31 is composed of the axes L33, L34, and L35 of the first, second, and third container segments 33, 34, and 35.

Figure 10:
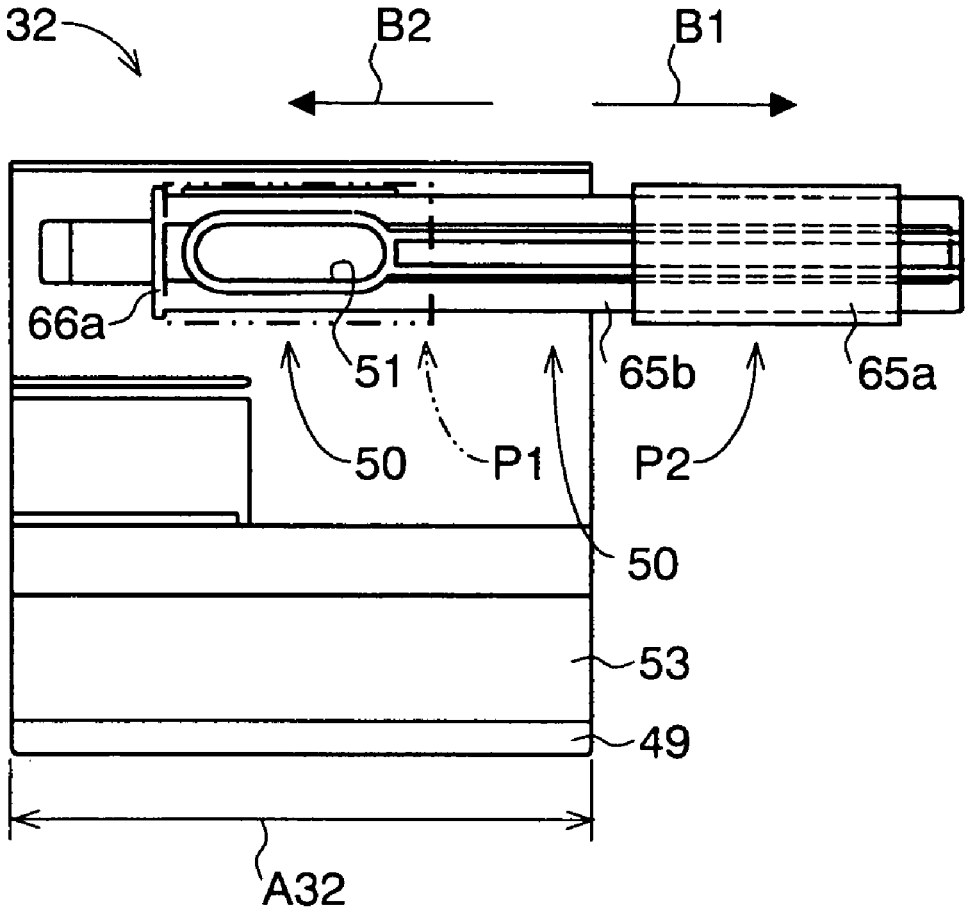
FIG. 10 is a front view showing a supporting member.
Figure 11:
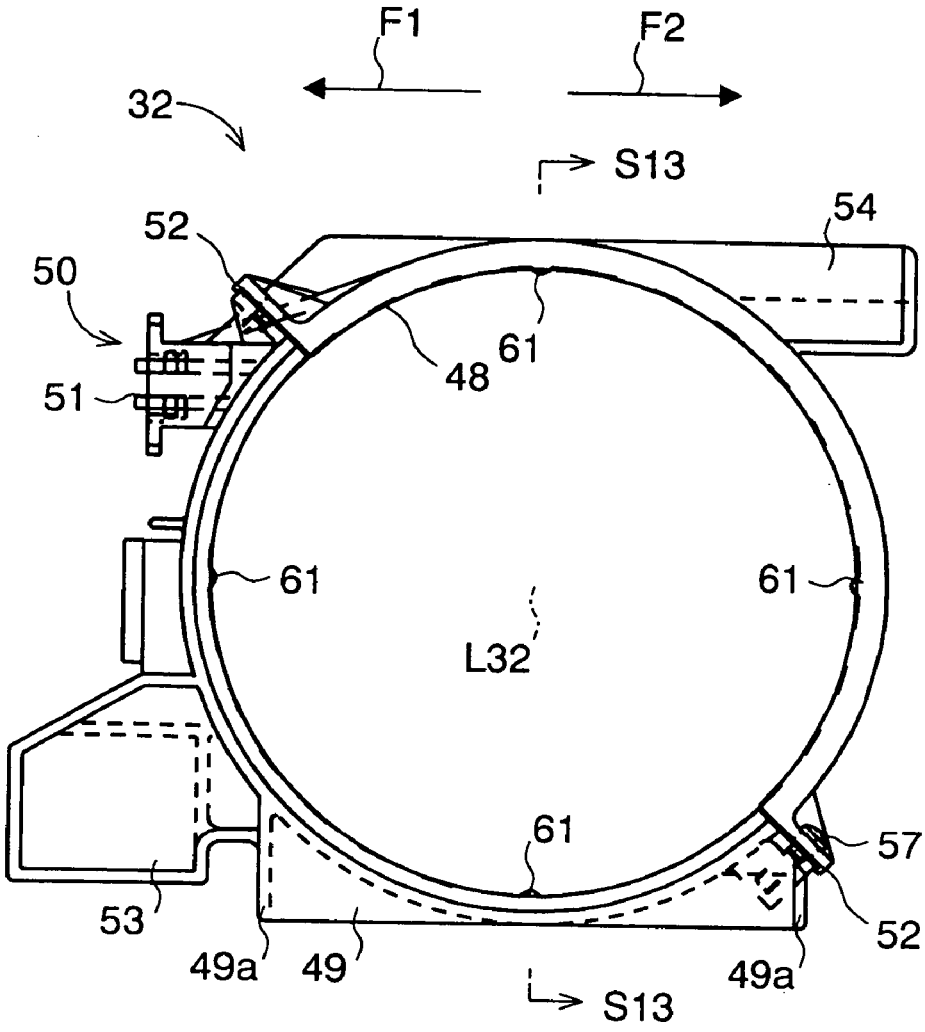
FIG. 11 is a right-hand side view showing the supporting member.

FIG. 10 is a front view showing the supporting member 32. FIG. 11 is a right-hand side view showing the supporting member 32. The supporting member 32, which is given substantially a cylindrical shape, has an inner periphery 48 for supporting the part of the container main body 31 of the above structure which includes at least the third container segment 35, from its outer side in the radial direction over its entire circumference. The inner periphery 48 has a cylindrical inner peripheral surface, the center of which coincides with the axis L32. The supporting member 32 includes a supporting base 49 having at least three or more abutment portions 49*a* on a virtual plane parallel to the axis L32. For example, the abutment portion 49*a* of the supporting base 49 is preferably formed as two rectangular planes, a longitudinal direction of which is aligned with a direction parallel to the axis L32. By bringing the abutment portion 49*a* of the supporting base 49 in contact with a horizontal surface, the supporting member 32 can be placed, with the axis L48 of its inner periphery 48 arranged in parallel with the horizontal surface. An axial length measurement A32 of the supporting member 32 is made longer than the axial length measurement A35 of the third container segment 35. The axial length measurement A32 of the supporting member 32 may be arbitrarily determined, for example, it is preferably set at 100 mm.

In the state where the supporting base 49 is placed horizontally, on the upper part of the supporting member 32 is formed a discharge section 50 protruding in one horizontal direction defined as "one first horizontal direction F1". In terms of the discharge section 50, in the axially middle position of the supporting member 32 is formed a leading through hole 51 so as to penetrate along one first horizontal direction F1 and to open in the shape of an ellipse extending in a direction parallel to the axis L32 of the supporting member. An internal diameter in the longitudinal direction of the leading through hole 51 is adjusted to be equal to or greater than the axial dimension W41 of the first concavity 41 and the axial dimension W42 of the second concavity 42 of the container main body 31.

In the discharge section 50 of the supporting member 32 is disposed a shutter portion 65 for switching a downstream side opening in one first horizontal direction F1 of the leading through hole 51 between an opened state and a closed state. The shutter portion 65 includes a shutter 65*a* and a shutter guide 65*b*. The shutter guide 65*b* extends along a second horizontal direction which is perpendicular to the first horizontal direction. Beside its upstream side end 66*a* in one second horizontal direction B1 is opened the leading through hole 51. The shutter 65*a* is supported by the shutter guide 65*b* so as to be slidable either in one second horizontal direction B1 or in the direction opposite thereto, namely, another second horizontal direction B2.

The shutter 65*a* is slidingly displaced along the shutter guide 65*b*, and is thereby arranged either in a closing position P1 as indicated by a chain double dashed line in FIG. 10 or in an opening position P2, at which the downstream side opening in the one first horizontal direction F1 of the leading through hole 51 is closed and opened. Moreover, the shutter 65*a* is restrained from further sliding displacement in the downstream side in the other second horizontal direction B2 beyond the closing position P1, and is also restrained from further sliding displacement in one second horizontal direction B1 beyond the downstream side end 66*b* in one second horizontal direction B1 of the shutter guide 65*b*. That is, the opening position P2 is located in a position on the downstream side in one second horizontal direction B1 as compared to the closing position P1, and is simultaneously located in a position on the upstream side in one second horizontal direction B1 as compared to the downstream side end in the one second horizontal direction B1 of the shutter guide 65*b*. In this way, the shutter 65*a*, on the one hand, is shifted from the closing position P1 to the opening position P2 by being slidingly displaced in one second horizontal direction B1, and, on the other hand, is shifted from the opening position P2 to the closing position P1 by being slidingly displaced in the other second horizontal direction B2.

Moreover, the supporting member 32 has two pieces of coupling projections 52 protruding outward in the radial direction. In the state where the supporting base 49 is placed horizontally, one of the coupling projections 52 is arranged above the discharge section 50, and the other coupling projection 52 is arranged symmetrically with the above one with respect to the axis L32. Further, the supporting member 32 has a first guide piece 53 which is arranged below the discharge section 50 in the state where the supporting base 49 is placed horizontally. The first guide piece 53 is so formed as to protrude in one first horizontal direction F1, and to extend in parallel with the axis L32. Still further, the supporting member 32 has a second guide piece 54 which is arranged above the discharge section 50 in the state where the supporting base 49 is placed horizontally. The second guide piece 54 is so formed as to protrude in another first horizontal direction F2 opposite to one first horizontal direction F1, and to extend in parallel with the axis L32.

Figure 12:
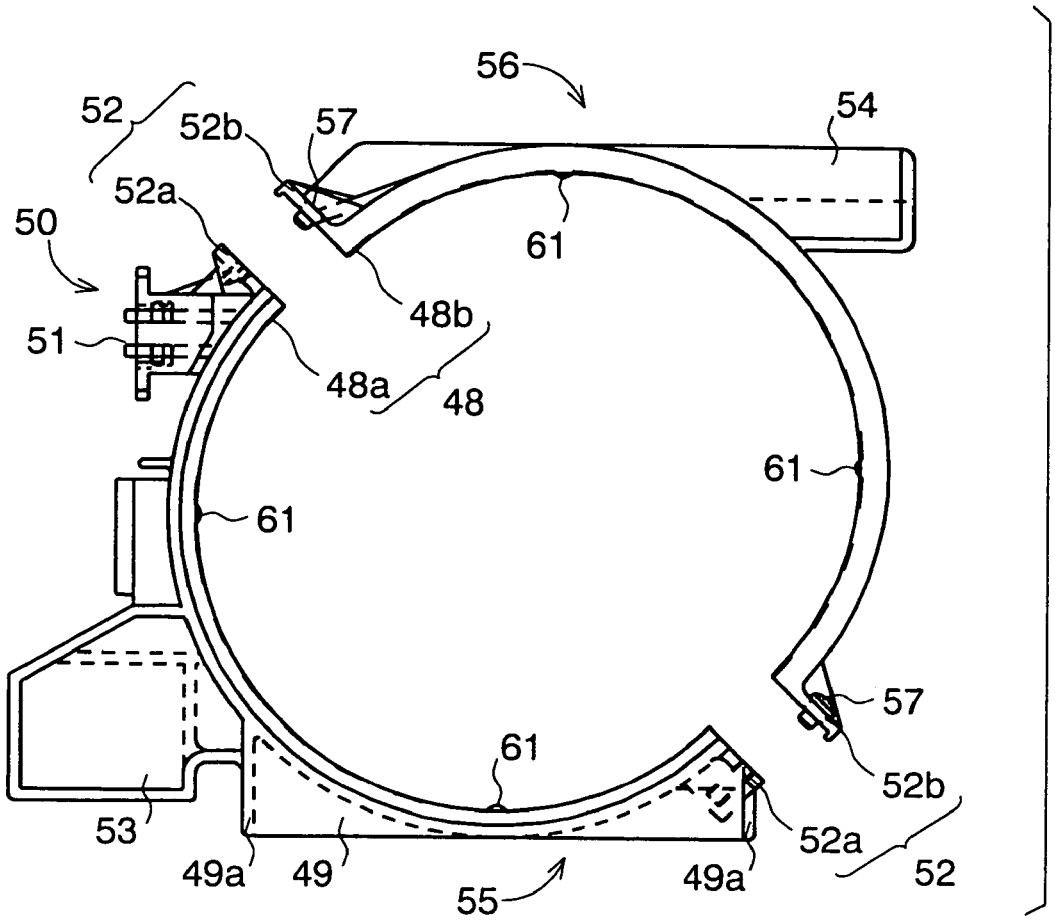
FIG. 12 is an exploded right-hand side view showing the supporting member.

FIG. 12 is an exploded right-hand side view showing the supporting member 32. In the horizontally-placed state, the supporting member 32 can be divided into two parts with respect to a virtual plane which passes along the axis L32 and is gradually inclined upwardly with increasing proximity to one first horizontal direction F1. Specifically, the supporting member 32 can be divided into a first supporting portion 55 and a second supporting portion 56. The first supporting portion 55 is located below the virtual plane, whereas the second supporting portion 56 is located above the virtual plane. In terms of the supporting member 32, the first supporting portion 55 includes the first guide piece 53; the discharge section 50; one part 52*a* of each of the coupling projection 52; the supporting base 49; and a part 48*a* on the first guide piece 53 side of the inner periphery 48. On the other hand, the second supporting portion 56 includes the second guide piece 54; the other part 52*b* of each of the coupling projection 52; and a part 48*b* on the supporting base 49 side of the inner periphery 48.

The first and second supporting portions 55 and 56 are attachably/detachably coupled to each other by a screw member 57. Specifically, one part 52*a* of each of the coupling projection 52 of the first supporting portion 55 is coupled to the other part 52*b* of each of the coupling projection 52 of the second supporting portion 56 by the screw member 57. The supporting member 32 is divided before it receives the container main body 31. Then, the divided supporting member 32 portions are assembled to support the part of the container main body 31 which includes the first and second concavities 41 and 42 and the discharge hole 43, from the radially outer side. Thereby, the container main body 31 can be supported over its entire circumference. The dividable configuration of the supporting member 32 helps facilitate the assembly operation.

Figure 13:
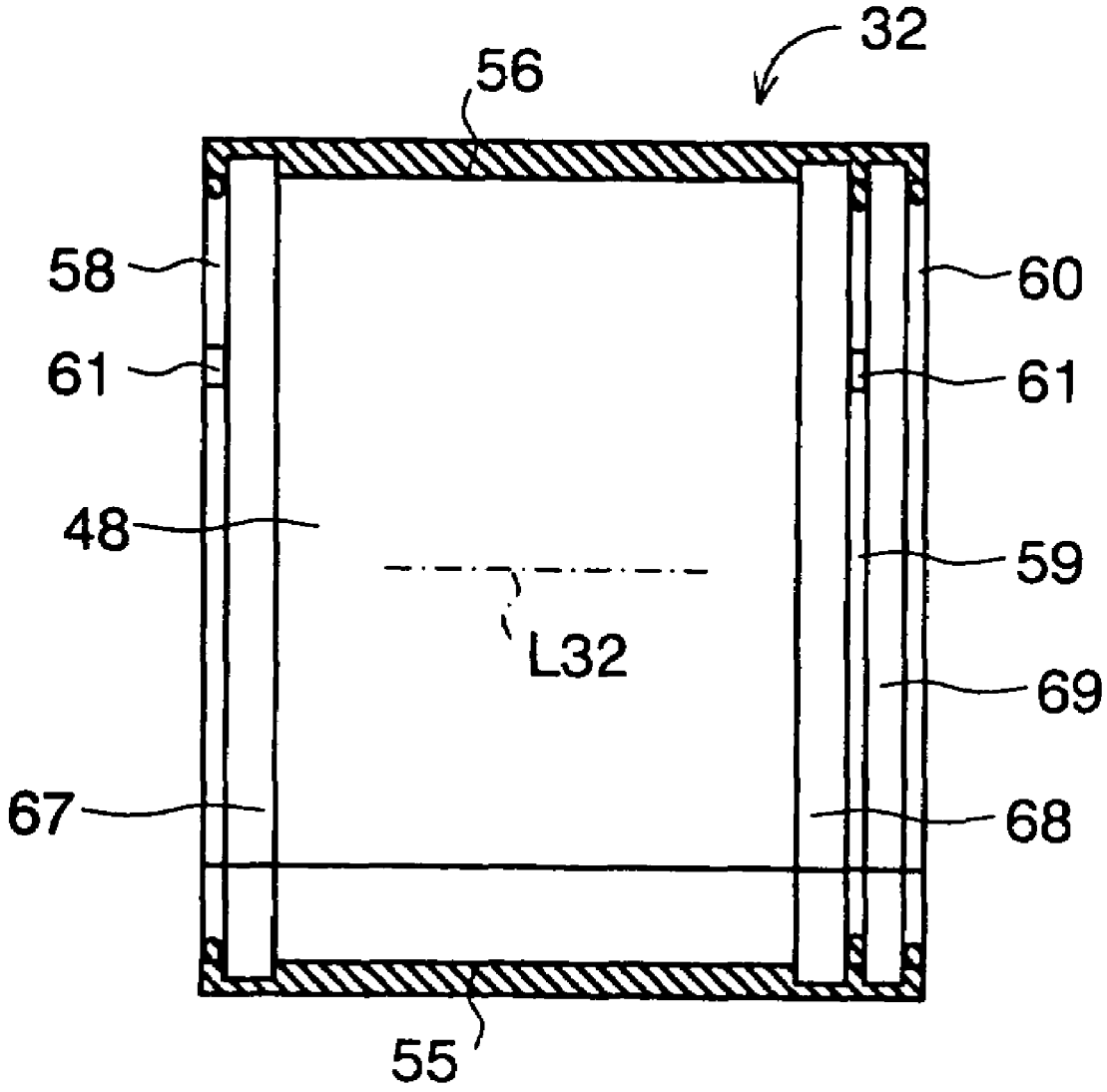
FIG. 13 is a sectional view taken along the line S13—S13 of FIG. 11.

FIG. 13 is a sectional view taken along the line S13—S13 of FIG. 11. Reference is now made also to FIG. 11. The supporting member 32 has, at one axial end of its inner periphery 48, a first supporting convexity 58 formed so as to protrude inward in the radial direction and to extend over an entire circumference in the circumferential direction, and also has, at the other axial end of its inner periphery 48, a second supporting convexity 59 formed so as to protrude inward in the radial direction and to extend over an entire circumference in the circumferential direction. The supporting member 32 additionally has, at the other axial end of its inner periphery 48, a third supporting convexity 60 formed so as to protrude inward in the radial direction and to extend an entire circumference in the circumferential direction. The third supporting convexity 60 is disposed in a position on the other axial end side as compared to the second supporting convexity 59, with a spacing secured therebetween. The axial spacing between the second and third supporting convexities 59 and 60 is made slightly larger than the axial dimension of the guide projection piece 40 of the second container segment 34 of the container main body 31. For example, it is preferably set at 3 mm.

The first and second supporting convexities 58 and 59 each have a plurality (four pieces, in this embodiment) of supporting projection pieces 61 protruding inward in the radial direction that are evenly spaced in the circumferential direction. In the supporting projection piece 61, its radially-inner front end has a supporting surface curved as a cylindrical outer peripheral surface. The supporting projection pieces 61 provided in the first and second supporting convexities 58 and 59 are each so configured that a diameter of a virtual circle passing along the front end of each of the guide projection pieces 40 about the axis L32 is made slightly longer than the outer diameter of the outer periphery of the first container segment 33 and the outer diameter of the outer periphery of the second container segment 34 excluding the guide projection piece 40. For example, the diameter is preferably set at 107 mm. The internal diameter of the third supporting convexity 60 is made slightly longer than the outer diameter of the outer periphery of the second container segment 34 excluding the guide projection piece 40. For example, the internal diameter is preferably set at 107 mm.

In adjacency to the other axial end of the first supporting convexity 58 formed at one axial end of the inner periphery 48 of the supporting member 32, a first supporting concavity 67 is formed so as to be sunk outward in the radial direction and to extend over an entire circumference in the circumferential direction. In adjacency to one axial end of the second supporting convexity 59 formed at the other axial end of the inner periphery 48 of the supporting member 32, a second supporting concavity 68 is formed so as to be sunk outward in the radial direction and to extend over an entire circumference in the circumferential direction. Moreover, between the second and third supporting convexities 59 and 60 formed at the other axial end of the inner periphery 48 of the supporting member 32 is formed a third supporting concavity 69 so as to be sunk outward in the radial direction and to extend over an entire circumference in the circumferential direction. For example, the axial dimension of the first, second supporting concavity 67, 68 is preferably set at 7 mm. The axial dimension of the third supporting concavity 69 is made slightly larger than the axial dimension of the guide projection piece 40 of the second container segment 34 of the container main body 31. For example, it is preferably set at 3 mm.

Figure 14:
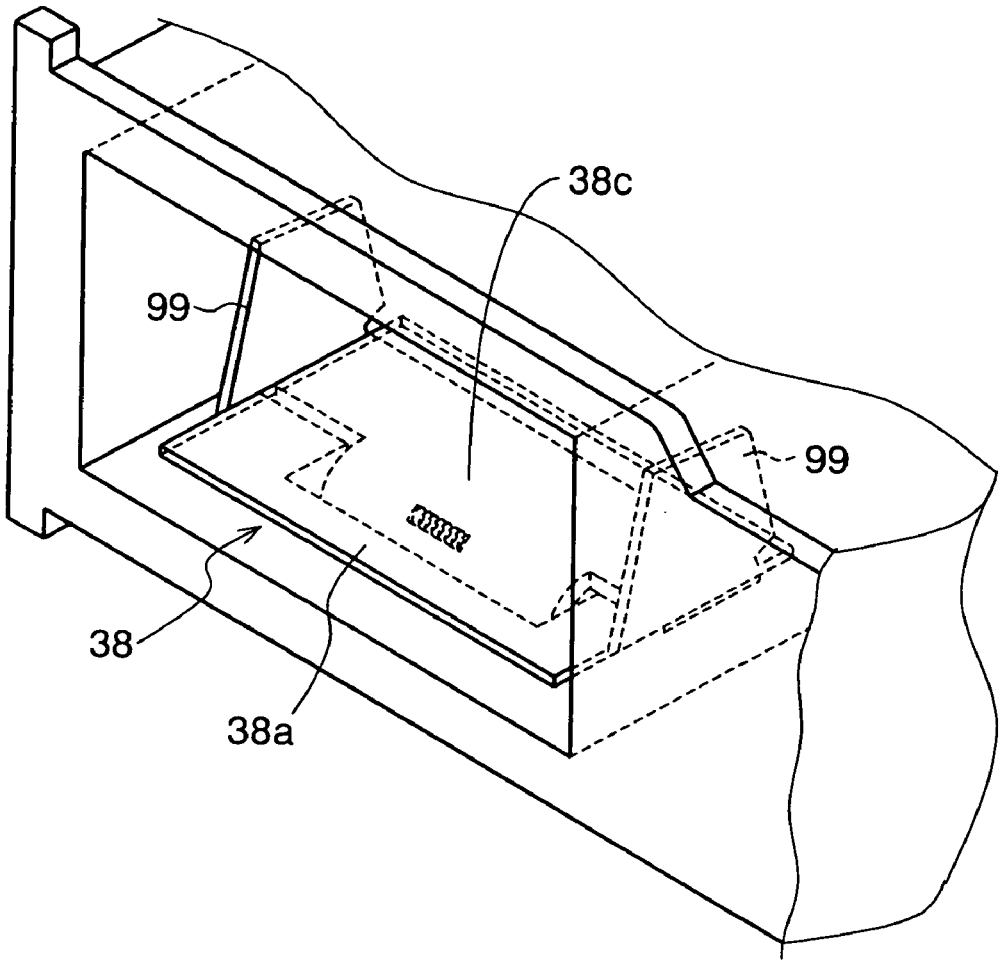
FIG. 14 is a perspective view showing a leading-out member, as seen from outside the supporting member.
Figure 15:
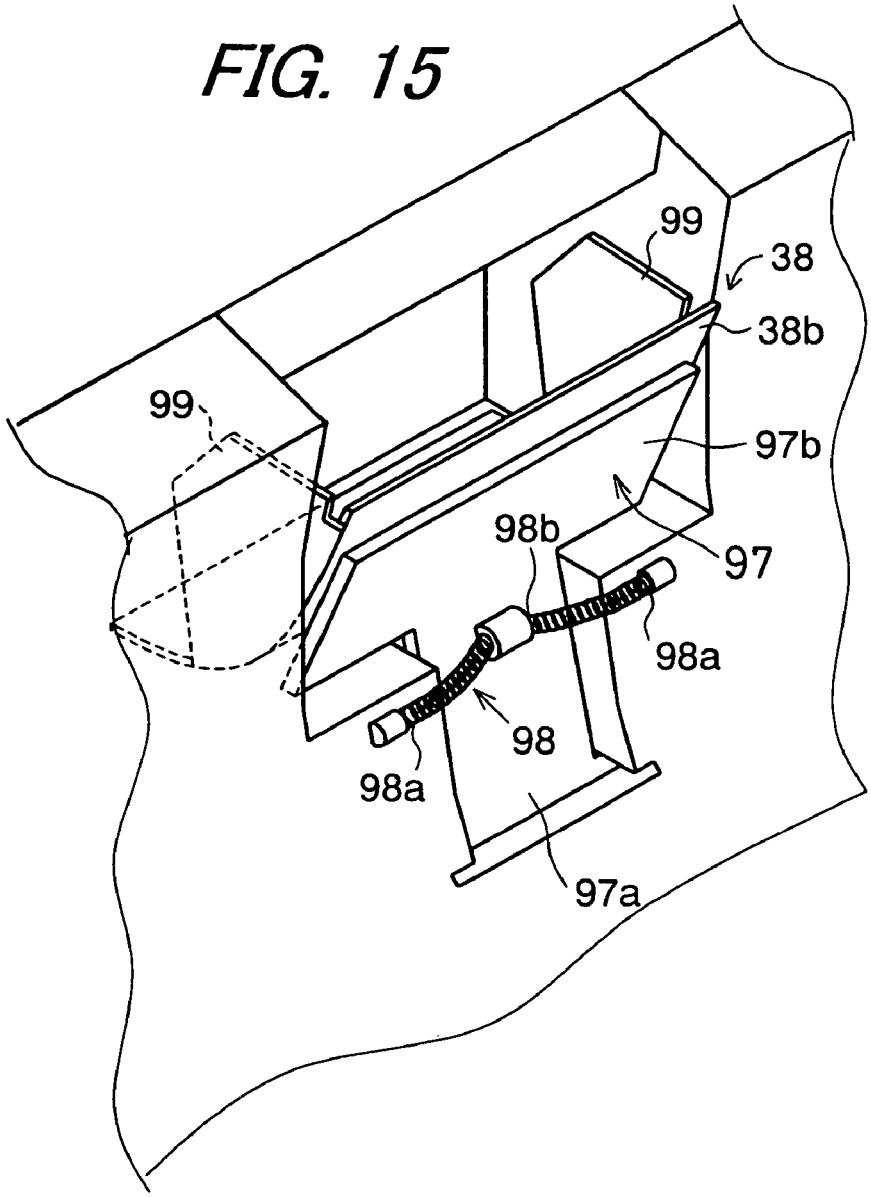
FIG. 15 is a perspective view showing the leading-out member, a deformation preventive member, and a spring member, as seen from an inner periphery of the supporting member.

FIG. 14 is a perspective view showing a leading-out member 38, as seen from outside the supporting member 32. FIG. 15 is a perspective view showing the leading-out member 38, a deformation preventive member 97, and a spring member 98, as seen from the inner periphery 48 of the supporting member 32. The developer container 30 further includes a leading-out member 38, a deformation preventive member 97, and a spring member 98. The leading-out member 38 is, in terms of the supporting member 32, formed in a sheet-like shape so as to face the path along which the first and second concavities 41 and 42 are moved in accompaniment with the rotation of the container main body 31. The leading-out member 38 extends from the leading through hole 51 toward the upstream side in the rotation direction. The leading-out member 38 leads the developer discharged from the discharge hole 43 of the container main body 31 to the leading through hole 51. In the leading-out member 38, at least its upstream side end 38*b* in the rotation direction is preferably made of a material possessing flexibility and resilience, such as polyethylene terephthalate (PET for short). Moreover, the leading-out member 38 has guide walls 99 which are formed at both axial ends thereof and protrude outward in the radial direction.

Note that the leading-out member 38 includes a downstream side end 38*a* in the rotation direction, an upstream side end 38*b* in the rotation direction, and a midsection 38*c* lying therebetween. The deformation preventive member 97 prevents the midsection 38*c* from being plastically deformed. Specifically, the deformation preventive member 97 includes a base end 97*a* and a free end 97*b*. The base end 97*a* is angularly displaceably coupled to the supporting base 49 side of the leading through hole 51 of the supporting member 32. The free end 97*b*, which is shaped like a flat plate extending in parallel with the rotation axis L31, is arranged in a position on the upstream side in the rotation direction as compared to the base end 97*a*, so as to face with the leading through hole 51 of the supporting member 32. The free end 97*b* is entirely fixed onto a surface on the downstream side in the rotation direction of the midsection 38*c* of the leading-out member 38. In this way, the deformation preventive member 97 is coupled to the supporting member 32 so as to be angularly displaceable about the angular displacement axis parallel to the rotation axis L31 passing through the base end 97*a*. In the deformation preventive member 97, at least the free end 97*b* is preferably made of a material which is sufficiently greater in rigidity than the leading-out member 38, for the purpose of preventing plastic deformation of the leading-out member 38. For example, a polymeric resin material such as polyacetal resin is adequate for the purpose.

The spring member 98, acting as resilient-force generating means, loads the leading-out member 38 with a resilient force that tends to bring the upstream side end 38*b* in the rotation direction of the leading-out member 38 into resilient contact with part of the outer peripheral surface of the container main body 31 corresponding to the first and second concavities 41 and 42. For example, the spring member 98 is realized by the use of a coil tension spring or a torsion spring. In this embodiment, a coil tension spring is employed. The spring member 98 is, at both ends 98*a* thereof in an elongation direction, fixed to the inner periphery 48 of the supporting member 32, and simultaneously is, at a middle portion 98*b* thereof in the elongation direction, fixed to the deformation preventive member 97 at a position near the free end 97*b*. In this way, the leading-out member 38 is loaded with a resilient force that tends to bring its upstream side end 38*b* in the rotation direction into resilient contact with part of the outer peripheral surface of the container main body 31 corresponding to the first and second concavities 41 and 42 through the deformation preventive member 97.

Figure 16A:
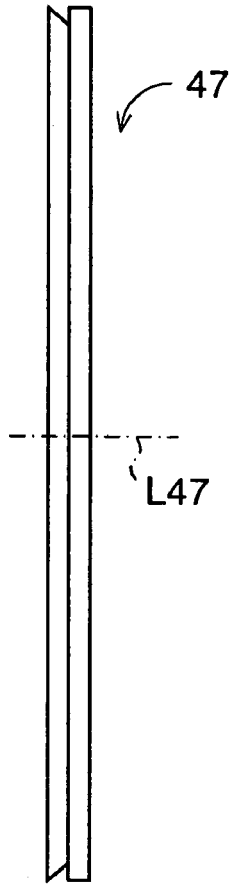
FIG. 16A is a front view showing a sealing material.
Figure 16B:
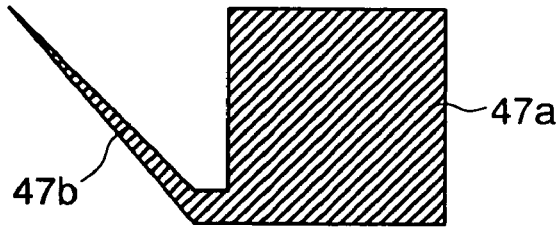
FIG. 16B is a view showing a cross section perpendicular to a circumferential direction of the sealing material.

FIG. 16A is a front view showing a sealing material 47. FIG. 16B is a view showing a cross section perpendicular to the circumferential direction of the sealing material 47. The sealing material 47, acting as sealing means, is made of a material possessing pliability and resilience, for example, a synthetic resin material such as silicon rubber. As shown in FIG. 16A, the sealing material 47 is given substantially an annular shape. As shown in FIG. 16B, the sealing material 47 includes a base portion 47*a* and an abutment portion 47*b*. In the sealing material 47, the base portion 47*a* is so configured that its cross section perpendicular to the circumferential direction around the axis L35 has a rectangular shape. The abutment portion 47*b* protrudes from one radially-inner axial end of the base portion 47*a* so as to be gradually inclined outward in the radial direction from the other axial end side to one axial end side.

The diameter of the inner periphery of the base portion 47*a* of the sealing material 47 is made shorter than the outer diameter of the outer periphery of the first container segment 33 and the outer diameter of the outer periphery of the second container segment 34 excluding the guide projection piece 40. For example, the diameter is preferably set at 99 mm. Moreover, the diameter of the outer periphery of the base portion 47*a* and the abutment portion 47*b* of the sealing material 47 is made equal to or greater than a diameter of a virtual circle passing along the outer periphery of each of the discharge guide pieces 44 of the third container segment 35 of the container main body 31 about the rotation axis L31. For example, the diameter is preferably set at 115 mm. Further, the axial dimension L47 of the sealing material 47 is made equal to or less than the axial dimension of the first, second supporting concavity 67, 68 of the supporting member 32. For example, the axial dimension is preferably set at 6 mm.

Figure 17:
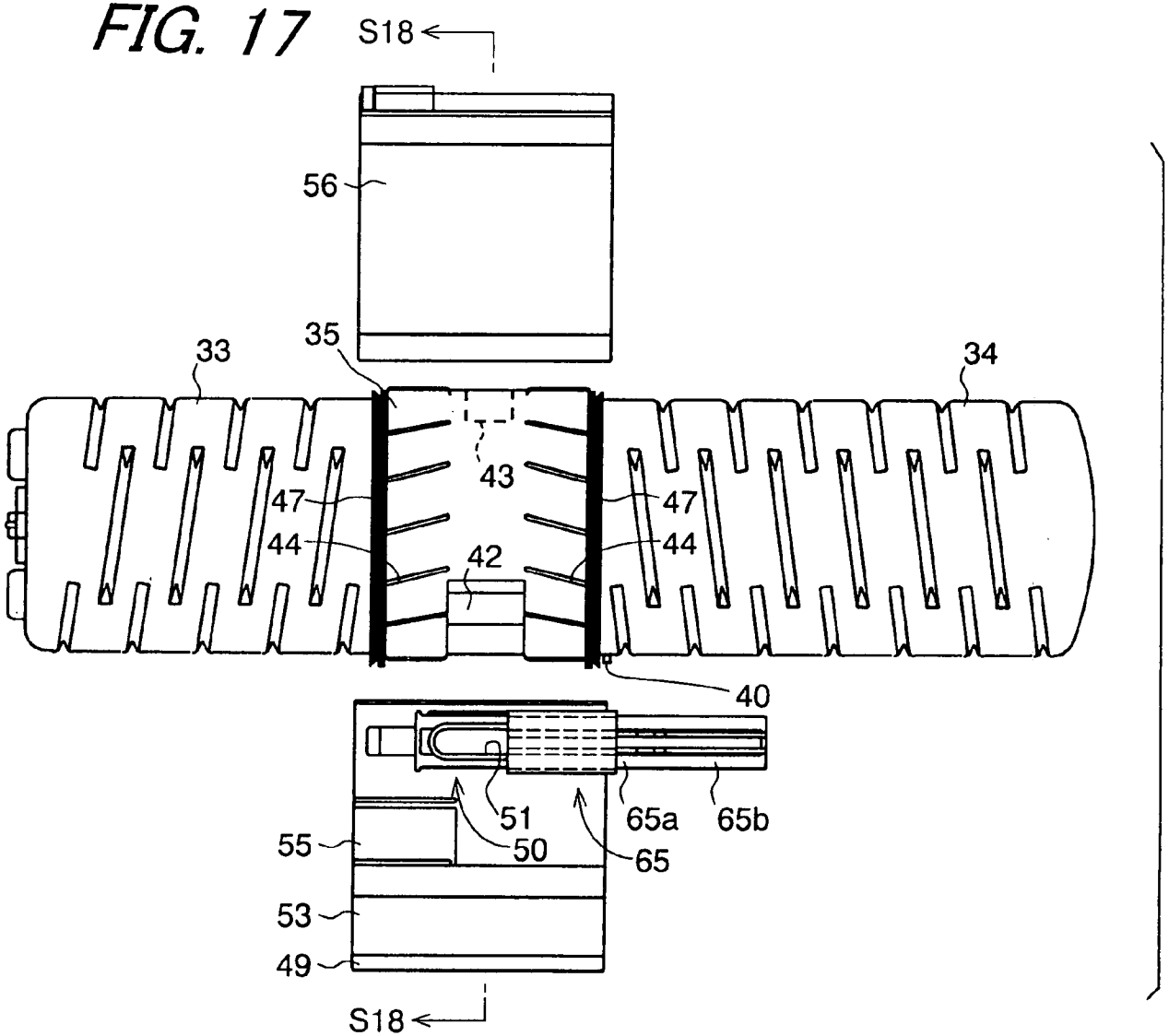
FIG. 17 is a front view showing how the developer container is assembled.
Figure 18:
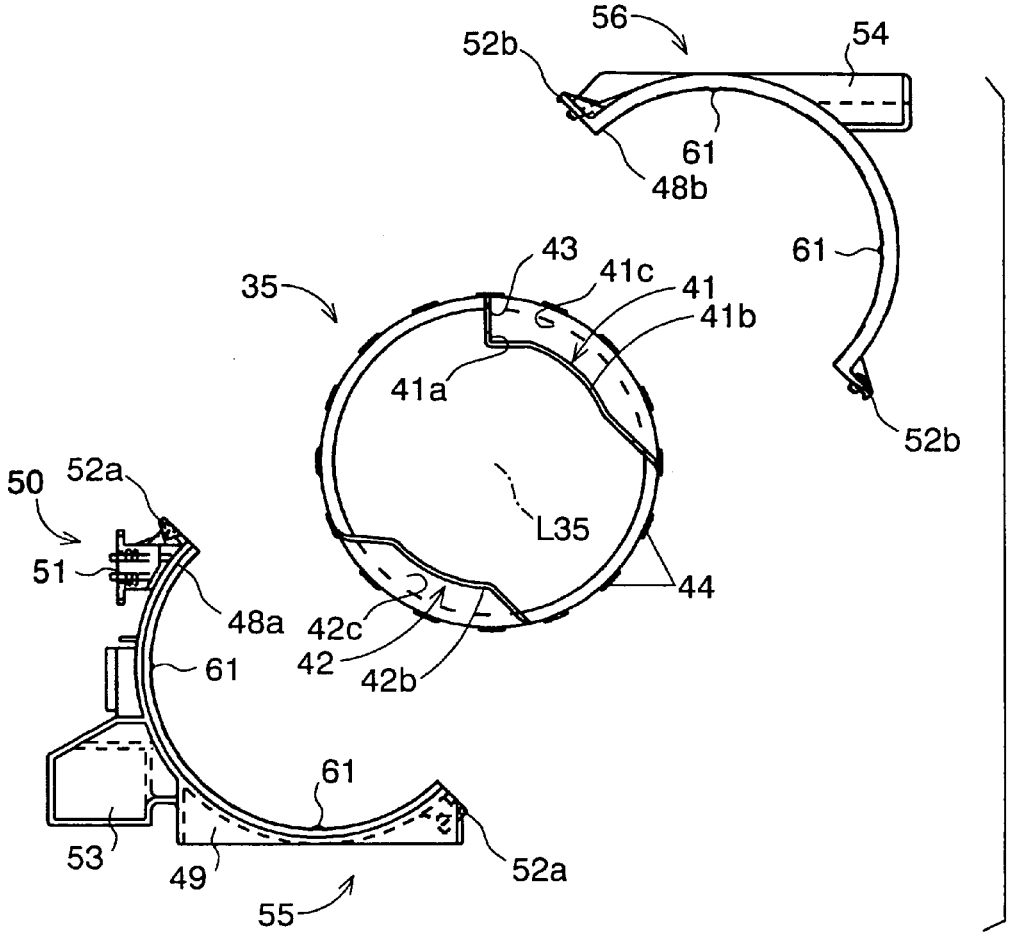
FIG. 18 is a sectional view taken along the line S18—S18 of FIG. 17.

FIG. 17 is a front view showing how the developer container 30 is assembled. FIG. 18 is a sectional view taken along the line S18—S18 of FIG. 17. Prior to the assembly of the developer container 30, the supporting member 32 is divided into the first and second supporting portions 55 and 56. At the same time, one of the two sealing materials 47 is attached to the first container segment 33 of the container main body 31 as follows: the sealing material 47 is wound tightly on the opening end 33*b* of the first container segment 33, with its base portion 47*a* brought into intimate contact with the end face of one axial end of the third container segment 35. Meanwhile, the other sealing material 47 is attached to the second container segment 34 of the container main body 31 as follows: the sealing material 47 is wound tightly on the opening end 34*b* of the second container segment 34 in a position on one axial end side as compared to the guide projection piece 40, with its base portion 47*a* brought into intimate contact with the end face of the other axial end of the third container segment 35.

The part of the container main body 31 which includes the third container segment 35 is grippingly held, from the outer side in the radial direction, by the first and second supporting portions 55 and 56. In this state, the first and second supporting portions 55 and 56 are coupled to each other by the screw member 57.

Figure 19:
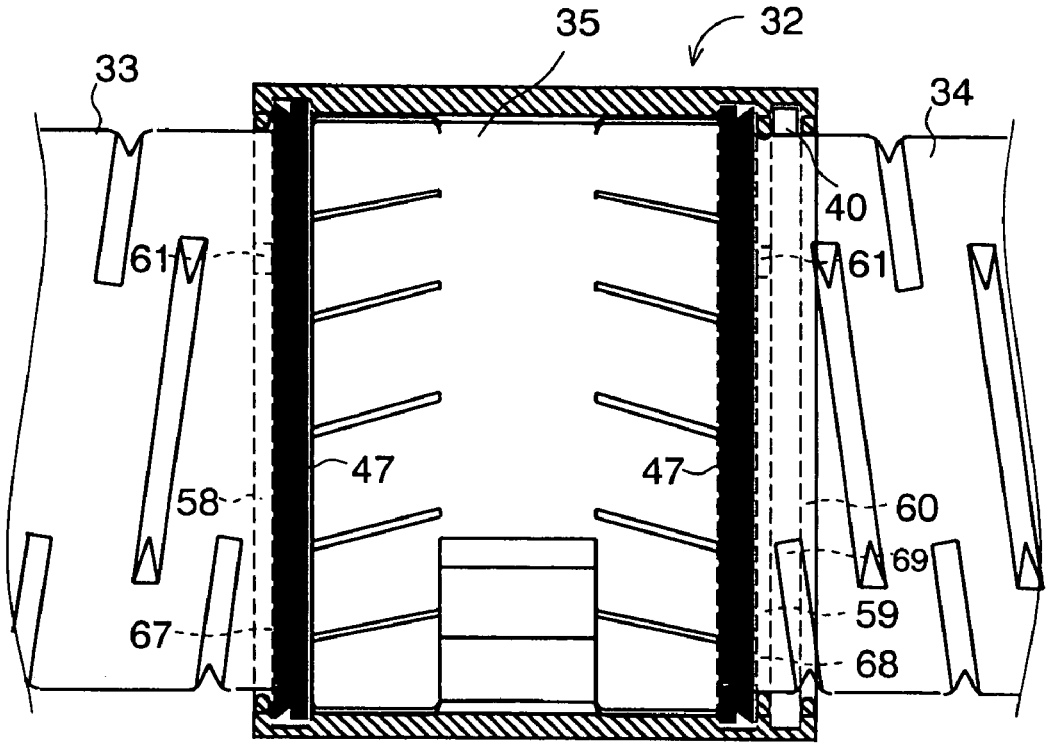
FIG. 19 is a sectional view taken along the line S19—S19 of FIG. 3.

FIG. 19 is a sectional view taken along the line S19—S19 of FIG. 3. In the state where the container main body 31 is supported by the supporting member 32, the axis L31 of the container main body 31 coincides perfectly or substantially with the axis L32 of the inner periphery 48 of the supporting member 32. Thus, the container main body 31 is rotatable about the axis L31 with respect to the supporting member 32. In the case where the supporting base 49 of the supporting member 32 is placed on a horizontal surface, with the container main body 31 kept supported thereby, the first and second container segments 33 and 34 of the container main body 31 are located away from the horizontal surface, and the horizontal surface and the rotation axis L31 are arranged parallel to each other.

In the supporting member 32, specifically, the supporting projection pieces 61 provided in the first supporting convexity 58 each abut against the outer periphery of the first container segment 33, whereas the supporting projection pieces 61 provided in the second supporting convexity 59 each abut against the outer periphery of the second container segment 34 excluding the guide projection piece 40. It follows from this that the outer periphery of the first container segment 33 is supported, at approximately four equi-spaced points in the circumferential direction, by each of the supporting projection pieces 61 of the first supporting convexity 58, and is simultaneously supported, at approximately four equi-spaced points in the circumferential direction, by each of the supporting projection pieces 61 of the second supporting convexity 59. This arrangement makes it possible to minimize the frictional force generated between the outer periphery of the first container segment 33 and the first supporting convexity 58, as well as the one generated between the outer periphery of the second container segment 34 and the second supporting convexity 59, against the rotation of the container main body 31.

The sealing material 47 of the first container segment 33 is fitted into the first supporting concavity 67 of the supporting member 32. The abutment portion 47*b* of the sealing material 47 abuts resiliently against the other axial end face of the first supporting convexity 58 over its entire circumference. The sealing material 47 of the second container segment 34 is fitted into the second supporting concavity 68 of the supporting member 32. The abutment portion 47*b* of the sealing material 47 abuts resiliently against one axial end face of the second supporting convexity 59 over its entire circumference. By the use of two sealing materials 47 such as shown herein, sealing can be achieved between the container main body 31 and the supporting member 32, over an entire circumference in the circumferential direction. That is, sealing can be achieved with respect to the first and second concavities 41 and 42 and the discharge hole 43 of the container main body 31, and part of the supporting member 32 closer to one and the other axial ends of the container main body 31 relatively to the leading through hole 51.

The guide projection piece 40 of the second container segment 34 of the container main body 31 is fitted into the third supporting concavity 69 of the supporting member 32, while being restrained from axial sliding displacement with respect to the supporting member 32. Resultantly, the container main body 31 is restrained from axial sliding displacement with respect to the supporting member 32. The outer periphery of each of the discharge guide pieces 44 of the third container segment 35 of the container main body 31 abuts against the inner periphery 48 of the supporting member 32. In this way, the supporting member 32 supports the part of the container main body 31 which includes at least the first concavity 41, from the outer side in the radial direction over the entire circumference, in such a way that the container main body 31 is rotatable about the rotation axis L31.

Figure 20:
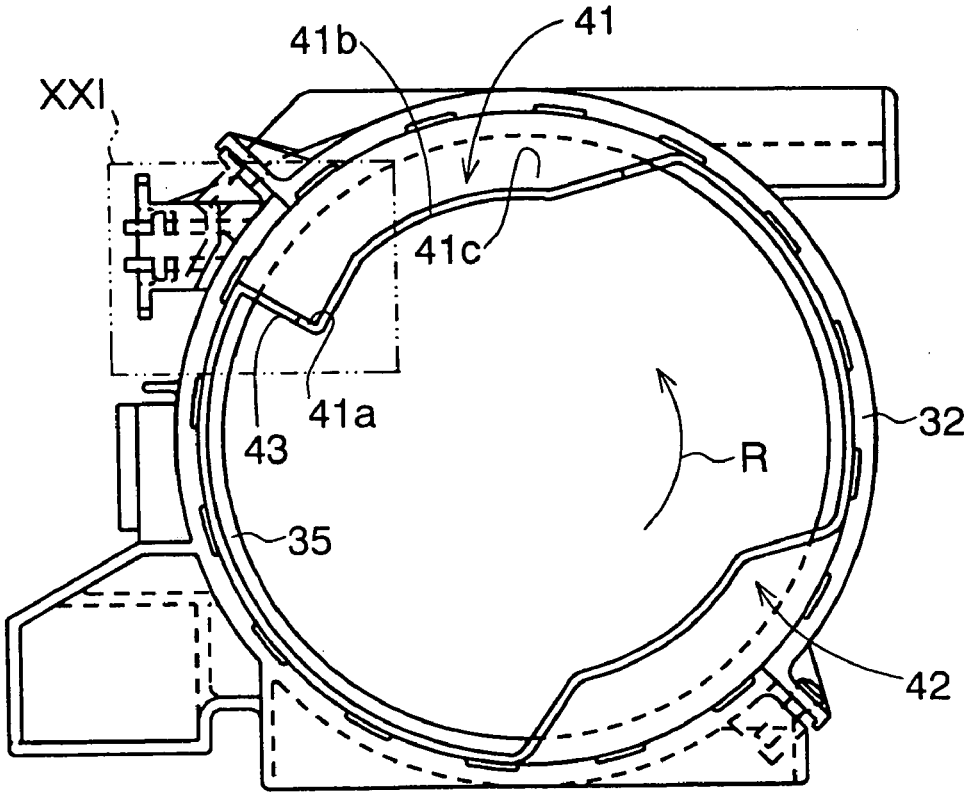
FIG. 20 is a sectional view taken along the line S20—S20 of FIG. 2.
Figure 21A:
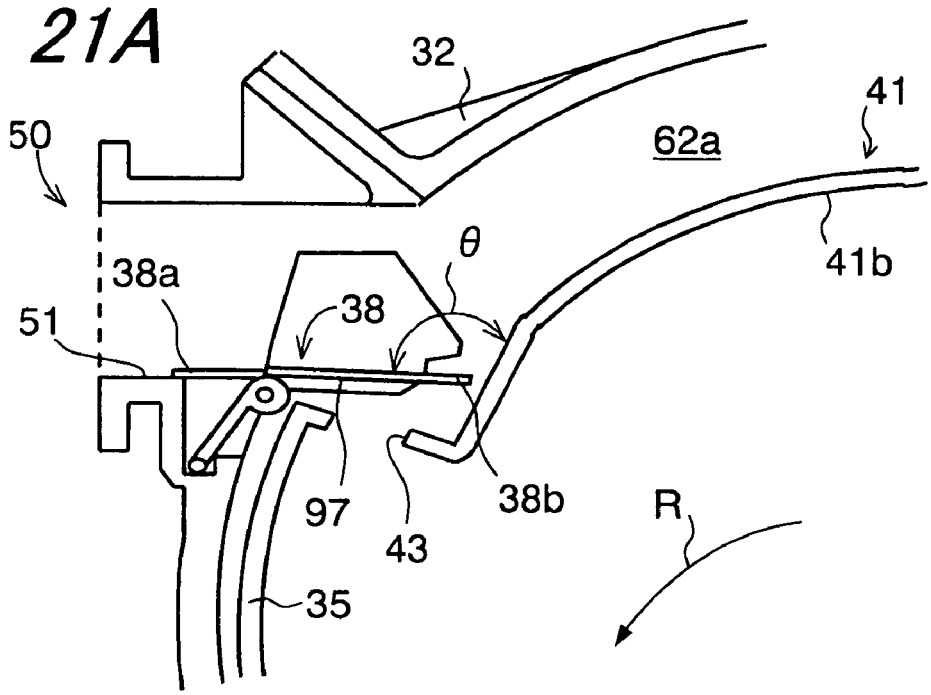
FIGS. 21A and 21B are enlarged views each showing Section XXI depicted in FIG. 20.
Figure 21B:
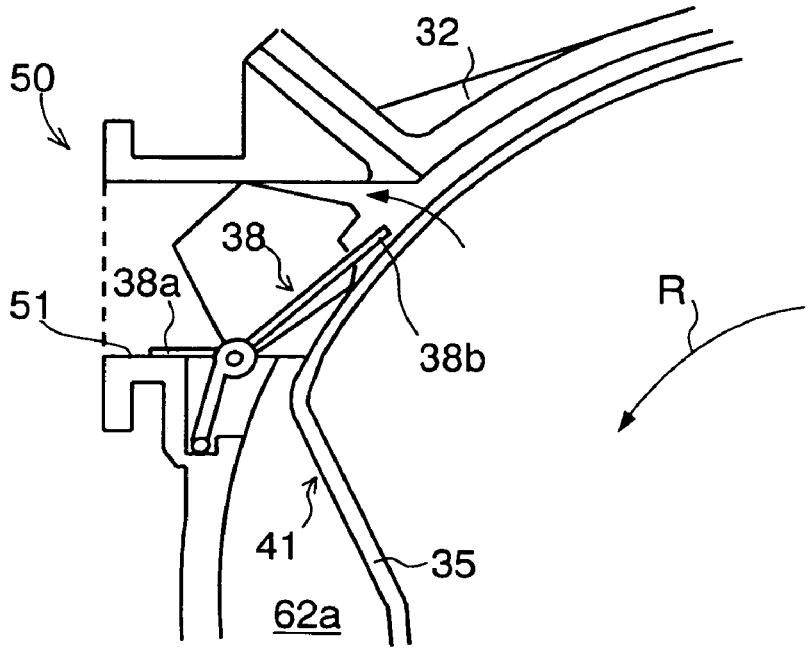
Figure 22A:
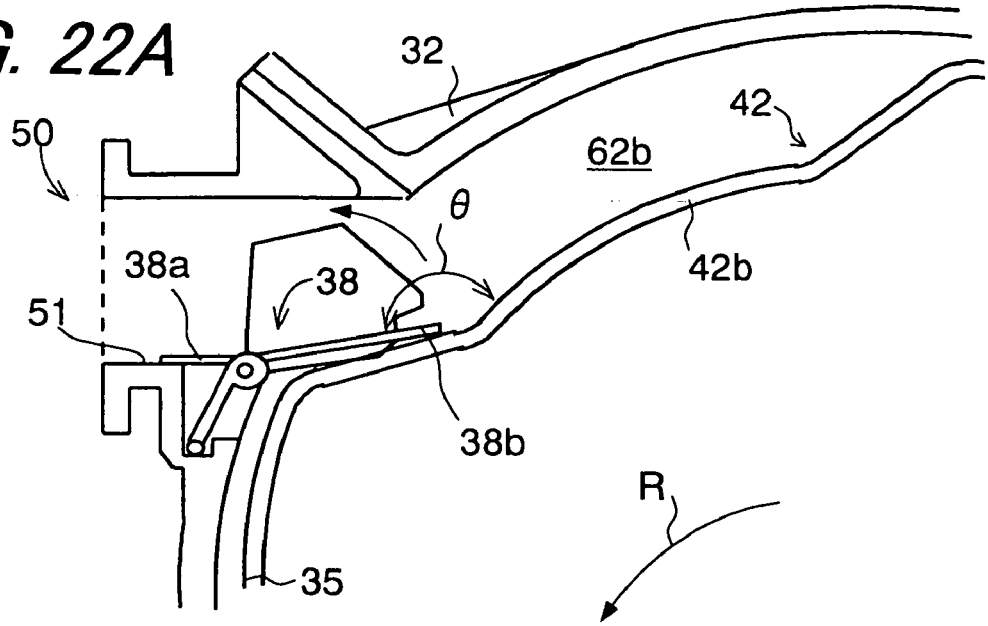
FIGS. 22A and 22B are enlarged views each showing Section XXI depicted in FIG. 20.
Figure 22B:
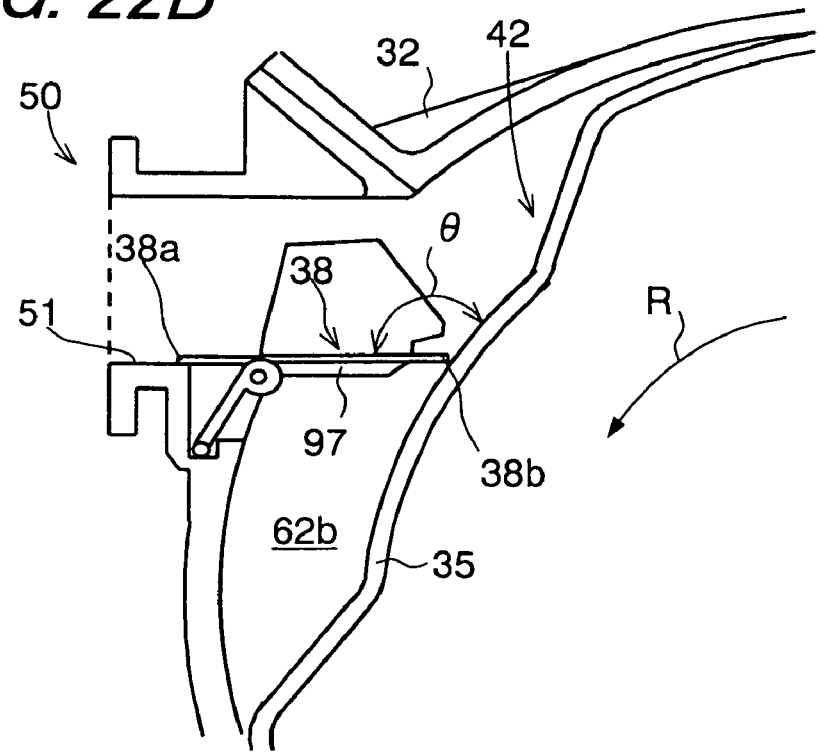

FIG. 20 is a sectional view taken along the line S20—S20 of FIG. 2. FIGS. 21A, 21B, 22A, and 22B are enlarged views each showing Section XXI depicted in FIG. 20. As described previously, the leading-out member 38 is angularly displaced, with its free end 38*b* abutting against the outer peripheral surface of at least the bottom wall portion 41*b*, 42*b* of the first, second concavity 41, 42 of the third container segment 35 of the container main body 31 at an angle θ of greater than 90 degrees. Specifically, the angle θ is formed between an upwardly-facing surface of the free end 38*b* of the leading-out member 38 and the outer peripheral surface of the bottom wall portion 41*b*, 42*b* of the first, second concavity 41, 42.

While the container main body 31 is kept in a developer-containing state with the supporting base 49 of the supporting member 32 placed horizontally, the internal space of the container main body 31 is composed of two layers: a developer layer made up by developer; and a pneumatic layer made up by gas present above the developer layer. The container main body 31 is rotated clockwise about the rotation axis L31, looking from the first container segment 33 to the second container segment 34. At this time, the developer constituting the developer layer in the first container segment 33 is conveyed, along the rotation axis L31, from the first container segment 33 toward the third container segment 35, or equivalently, conveyed in a first conveying direction C1 (refer to FIG. 2) by each of the first projection pieces 36. At the same time, the developer constituting the developer layer in the second container segment 34 is conveyed, along the rotation axis L31, from the second container segment 34 toward the third container segment 35, or equivalently, conveyed in a second conveying direction C2 (refer to FIG. 2) by each of the second projection pieces 39. In this way, by rotating the container main body 31 about the rotation axis L31, the developer contained therein can be conveyed toward the discharge hole 43. Moreover, in the third container segment 35, the developer traveling in the first conveying direction C1 and the developer traveling in the second conveying direction C2 come into collision with each other, thereby achieving agitation of the developer.

The developer is under a force when conveyed to travel from the inner periphery of the first container segment 33 (the second container segment 34) including the first projection piece 36 (the second projection piece 39) toward the third container segment 35. When the developer contained in the container main body 31 is larger in quantity, part of the developer located within the jutting amount A2 by which the first projection piece 36 (the second projection piece 39) juts radially inward from the inner periphery of the first container segment 33 (second container segment 34) is agitated mainly by the rotation of the container main body 31, thereby striking a proper developer balance in the container main body 31.

FIGS. 23A, 23B, 24A, and 24B are views of assistance in explaining operations for guiding the developer contained in the third container segment 35 of the container main body 31 to the leading through hole 51 of the supporting member 32, while the container main body 31 is being rotated about the rotation axis L31 in the rotation direction R. Reference is now made also to FIGS. 7, 9A, 9B, and 20. In the state where the container main body 31 is supported by the supporting member 32 so as to be rotatable about the rotation axis L31, a first retaining space 62*a* is created facing the first concavity 41 of the third container segment 35 and the inner periphery 48 of the supporting member 32. The first retaining space 62*a* is kept in substantially an enclosed state (apart from the discharge hole 43). The first retaining space 62*a* is arranged on the upstream side in the rotation direction R of the discharge hole 43, and is continuous with the space 64 within the container main body 31 via the discharge hole 43. At the same time, a second retaining space 62*b* is created facing the second concavity 42 of the third container segment 35 and the inner periphery 48 of the supporting member 32. The second retaining space 62*b* is kept in substantially an enclosed state.

Figure 23A:
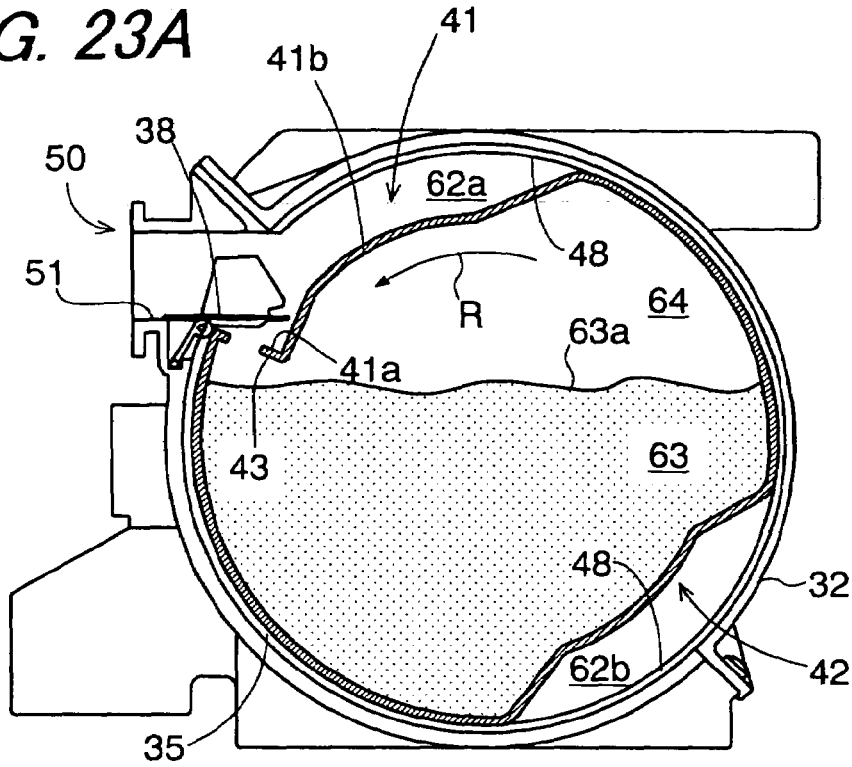
FIGS. 23A and 23B are views of assistance in explaining operations for guiding the developer contained in the third container segment of the container main body to a leading through hole of the supporting member, while the container main body is being rotated about a rotation axis L31 in a rotation direction R.
Figure 23B:
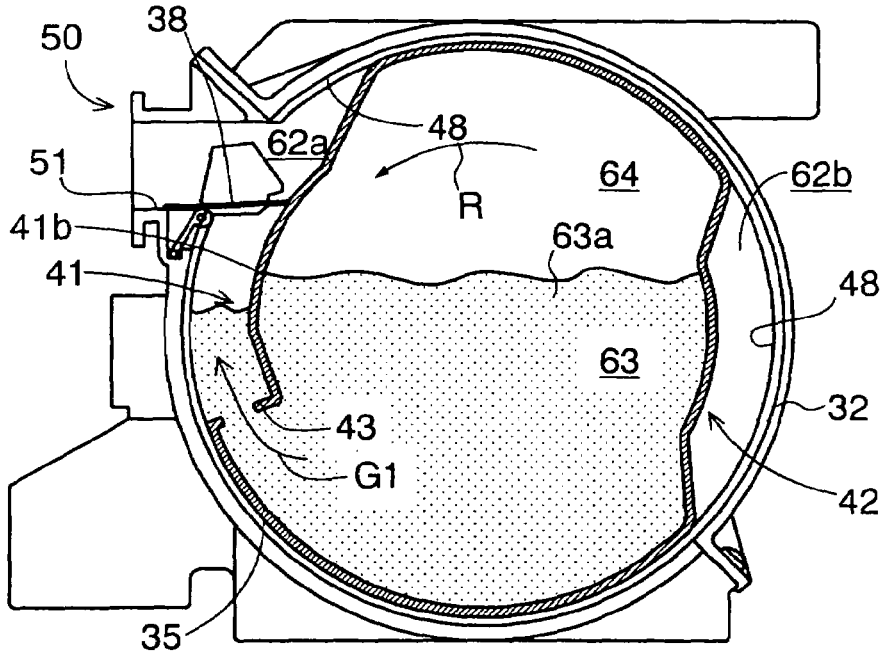

Upon the rotation of the container main body 31 in the rotation direction R, the condition is changed from the state as shown in FIG. 23A in which the discharge hole 43 and the first retaining space 62*a* are located above an upper face 63*a* of the developer layer 63 existing within the container main body 31, to the state as shown in FIG. 23B in which the discharge hole 43 and a downstream side part in the rotation direction R of the first retaining space 62*a* are located below the upper face 63*a* of the developer layer 63 existing within the container main body 31. Then, as indicated by the arrow G1, the developer constituting the developer layer 63 contained within the container main body 31 starts to flow through the discharge hole 43 into the downstream side part in the rotation direction R of the first retaining space 62*a*.

As described previously, the discharge hole 43 is formed in the axially middle position of the end wall portion 41*a* of the first concavity 41 so as to be located outward in the radial direction. Moreover, the discharge hole 43 is shaped as a rectangular opening, the lengthwise direction of which is aligned with the axial direction. Thus, in the end wall portion 41*a* of the first concavity 41, the discharge hole 43 is opened outward in the radial direction as compared to the downstream side end in the rotation direction R of the bottom wall portion 41*b* of the first concavity 41; opened in a position on the the other axial end side as compared to the downstream side end in the rotation direction R of the first side wall portion 41*c*; and opened in a position on the one axial end as compared to the downstream side end in the rotation direction R of the second side wall portion 41*d*.

For example, assuming that the discharge hole 43 is so formed as to open all over the area of the end wall portion 41*a*. In this case, upon the rotation of the container main body 31 in the rotation direction R, the developer is squeezingly moved along the first concavity 41 of the container main body 31 and the inner periphery 48 of the supporting member 32, so that it may be discharged from the discharge hole 43 into the first retaining space 62*a*. Then, upon further rotation of the container main body 31 in the rotation direction R, the developer retained in the first retaining space 62*a* is pressed by the first concavity 41 of the container main body 31 and the inner periphery 48 of the supporting member 32, which may lead to coagulation of the developer. In view of the foregoing, in this embodiment, as described above, the discharge hole 43 is formed in part of the end wall portion 41*a* of the first concavity 41, in other words, the opening area of the discharge hole 43 is made narrower than the area of the end wall portion 41*a*. This allows, in the vicinity of the discharge hole 43, the developer to be diffusely discharged into the first retaining space 62*a*. As a result, the developer discharged into the first retaining space 62*a* can be pulverized into fine particles, and the possibility of the above stated developer coagulation caused by the rotation of the container main body 31 can be minimized.

Moreover, the radially-outer surface of the discharge hole 43 is made smoothly continuous with a part of the inner peripheral surface of the third container segment 35 excluding the first and second concavities 41 and 42 which is located on the downstream side in the rotation direction R of the first concavity 41. This allows, even if the developer contained in the container main body 31 is very small in quantity, the developer to flow smoothly into the downstream side part in the rotation direction R of the first retaining space 62*a* through the discharge hole 43.

Figure 24A:
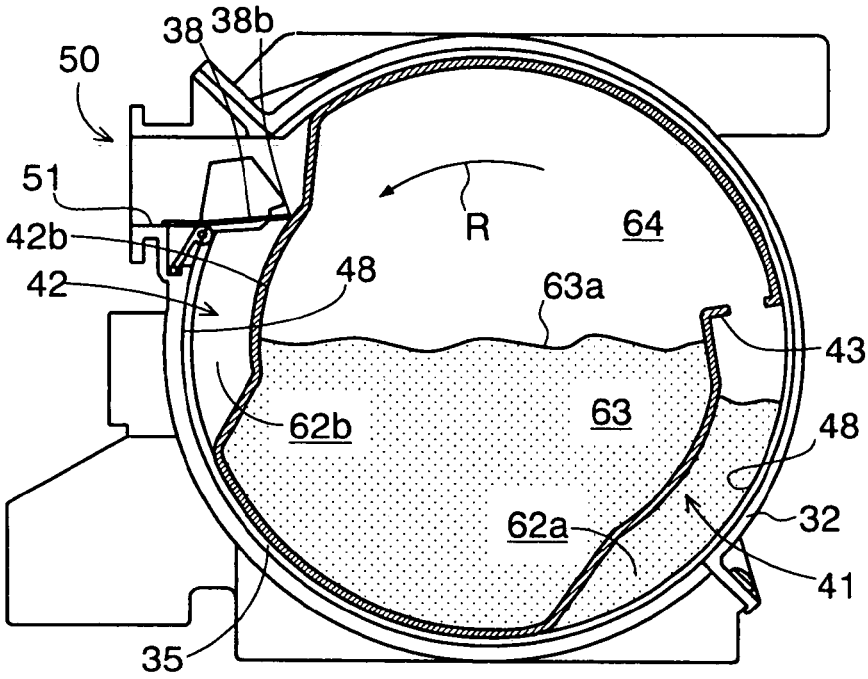
FIGS. 24A and 24B are views of assistance in explaining operations for guiding the developer contained in the third container segment of the container main body to the leading through hole of the supporting member, while the container main body is being rotated about the rotation axis L31 in the rotation direction R.

In the state as shown in FIG. 23B, the developer constituting the developer layer 63 contained within the container main body 31 flows through the discharge hole 43 into the downstream side part in the rotation direction R of the first retaining space 62*a*. Then, upon further rotation of the container main body 31 in the rotation direction R, the condition is changed from the state as shown in FIG. 23B to the state as shown in FIG. 24A in which the discharge hole 43 is located above the upper face 63*a* of the developer layer 63 existing within the container main body 31, whereas the first retaining space 62*a* is located below the upper face 63*a* of the developer layer 63 existing within the container main body 31. In the state as shown in FIG. 24A, a predetermined quantity of developer is retained in the first retaining space 62*a*. For example, the quantity of developer to be retained in the first retaining space 62*a* is preferably set at 6 gram.

Figure 24B:
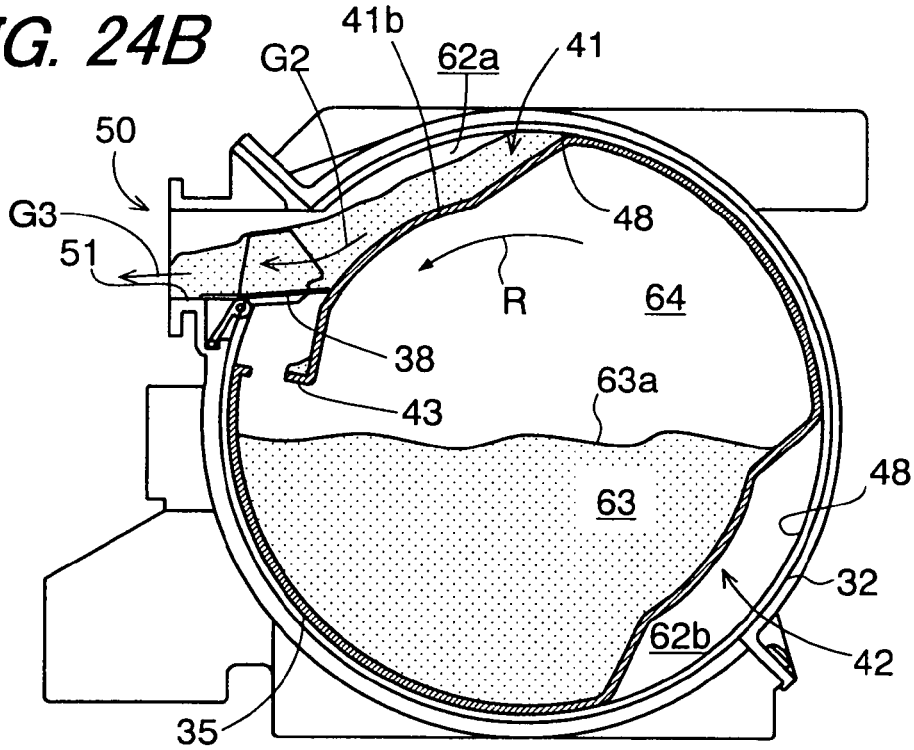

Upon still further rotation of the container main body 31 in the rotation direction R, the condition is changed from the state as shown in FIG. 24A to the state as shown in FIG. 24B in which the free end 38*b* of the leading-out member 38 of the supporting member 32 enters the first retaining space 62*a*, so that it juts out on the upstream side in the rotation direction R, and abuts resiliently against the outer peripheral surface of the bottom wall portion 41*b* of the first concavity 41 slidingly at an angle θ of greater than 90 degrees. At this time, the developer, retained in the first retaining space 62*a* located in a position on the upstream side in the rotation direction R as compared to the leading-out member 38, finds its way toward the supporting member 32 in accompaniment with the rotation of the container main body 31 in the rotation direction R.

As indicated by the arrow G2, the leading-out member 38 guides the developer that thus flowed in, in other words, the developer having been discharged from the discharge hole 43 of the container main body 31, along its upper surface, to lead it to the leading through hole 51. The leading-out member 38 slides over the outer peripheral surface of the bottom wall portion 41*b* of the first concavity 41 in such a way that the developer is scraped off the outer peripheral surface. Therefore, the developer retained in the first retaining space 62*a* can be directed to the leading through hole 51 as wholly as possible. The developer that thus reached the leading through hole 51 is then discharged out of the developer container 30 as indicated by arrow G3. In this way, every time the container main body 31 makes one rotation about the rotation axis L31 in the rotation direction R, the above-stated predetermined quantity of developer is discharged to the outside.

As described previously, in order to reduce the frictional force that hinders the rotation of the container main body 31 about the rotation axis L31, the inner periphery 48 of the supporting member 32 and the third container segment 35 excluding the first and second concavities 41 and 42 are designed so as not to abut against each other over the entire circumference in the circumferential direction. Such a structure is not without the potential of the leakage of the developer retained in the first retaining space 62*a* as described above. Hence, as described previously, the discharge guide pieces 44 are disposed about the outer periphery of each of one and the other axial ends of the third container segment 35 excluding the first and second concavities 41 and 42. The discharge guide piece 44 disposed at one axial end of the third container segment 35 is gradually inclined in the rotation direction R from the other axial end side to one axial end side. On the other hand, the discharge guide piece 44 disposed at the other axial end of the third container segment 35 is gradually inclined in the rotation direction R from one axial end side to the other axial end side. As a result, in the event that the developer retained in the first retaining space 62*a* leaks therefrom toward one and the other sides as viewed in the direction of the rotation axis L32, during the rotation of the container main body 31 in the rotation direction R, each of the discharge guide pieces 44 gather the developer particles around the axially middle position of the third container segment 35 and the supporting member 32.

Another advantageous feature is that, as described above, the second retaining space 62*b* is additionally provided. In the event that the developer retained in the first retaining space 62*a* leaks from its upstream side part in the rotation direction R, the leakage developer, as well as the developer gathered around the axially middle position by each of the discharge guide pieces 44, is retained in the second retaining space 62*b*. Upon the rotation of the container main body 31 in the rotation direction R, as shown in FIG. 24A, the free end 38*b* of the leading-out member 38 of the supporting member 32 enters the second retaining space 62*b*, so that it juts out on the upstream side in the rotation direction R, and abuts resiliently against the outer peripheral surface of the bottom wall portion 42*b* of the second concavity 42 slidingly at an angle θ of greater than 90 degrees. At this time, the developer, retained in the second retaining space 62*b* located in the a position on the upstream side in the rotation direction R as compared to the leading-out member 38, finds its way toward the supporting member 32 in accompaniment with the rotation of the container main body 31 in the rotation direction R. Then, the developer is directed to the leading through hole 51 to be discharged out of the developer container 30. In this way, in the event of the developer leaking from the first retaining space 62*a*, every time the container main body 31 makes one rotation about the rotation axis L31 in the rotation direction R, the Leakage developer can be retained in the second retaining space 62*b*. As a result, the above-stated predetermined quantity of developer can be discharged to the outside as reliably as possible.

Further advantageous feature is that, as described previously, in the state where the supporting base 49 is placed horizontally, on the upper part of the supporting member 32 is disposed the discharge section 50 protruding in one of the horizontal directions, namely, one first horizontal direction F1. In terms of the discharge section 50, in the axially middle position of the supporting member 32 is disposed the leading through hole 51 so as to penetrate along one first horizontal direction F1 and to open in the shape of an ellipse extending in a direction parallel to the axis L32 of the supporting member. With this arrangement, even if the container main body 31 is full of developer, the upper face 63*a* of the developer layer 63 is kept located at or below the level of the leading through hole 51. As a result, the developer can be prevented from inappropriately flowing from the container main body 31 into the leading through hole 51 without fail.

Figure 25:
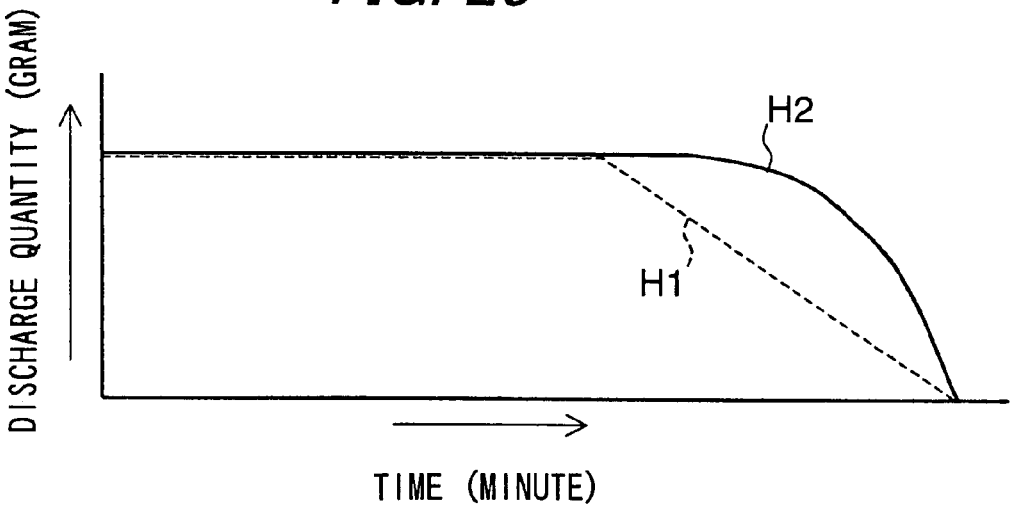
FIG. 25 is a graph showing the relationship between the time and the quantity of developer which is discharged from the developer container.

FIG. 25 is a graph showing the relationship between the time and the quantity of developer which is discharged from the developer container 30. In FIG. 25, the curve H1 indicates the relationship between the time and the quantity of developer which is discharged from the developer container 30, as observed when the internal diameter D35 of the third container segment 35 of the container main body 31 is made equal to or shorter than the internal diameter D33, D34 of the first, second container segment 33, 34. On the other hand, the curve H2 indicates the relationship between the time and the quantity of developer which is discharged from the developer container 30, as observed when the internal diameter D35 of the third container segment 35 of the container main body 31 is made longer than the internal diameter D33, D34 of the first, second container segment 33, 34. Here, attention is paid to the property of developer. For example, even if fine powdery developer particles are heaped up into a sharp-pointed mound on a horizontal surface, it immediately begins to lose its sharpness. In this connection, in the case where the internal diameter D35 of the third container segment 35 of the container main body 31 is made equal to or shorter than the internal diameter D33, D34 of the first, second container segment 33, 34, the developer being conveyed toward the discharge hole 43 in accompaniment with the rotation of the container main body 31 starts to move away from the discharge hole 43 immediately after the rotation of the container main body 31 comes to a halt. In such a case, during the container main body 31 contains only a very small quantity of developer left, it becomes difficult to convey a sufficient quantity of developer toward the discharge hole 43 immediately after the resumption of the rotation of the container main body 31.

In this embodiment, as described previously with reference to FIG. 8, the internal diameter of the third container segment 35 of the container main body 31 is made longer than the internal diameter D33, D34 of the rest first, second container segment 33, 34. Therefore, while the container main body 31 contains only a very small quantity of developer left, the developer that has once reached the third container segment 35 can be prevented from leaving the third container segment 35 as reliably as possible. As a result, even when the container main body 31 contains only a very small quantity of developer left, a sufficient quantity of developer can be conveyed toward the discharge hole 43 as reliably as possible immediately after the resumption of the rotation of the container main body 31. Besides, the developer contained in the container main body 31 can be discharged to the outside as wholly as possible.

As indicated by the curve H1, in the case where the internal diameter D35 of the third container segment 35 of the container main body 31 is made equal to or shorter than the internal diameter D33, D34 of the first, second container segment 33, 34, as the quantity of the developer contained in the container main body 31 is decreased, the quantity of developer discharge is decreased correspondingly sharply. On the other hand, as indicated by the curve H2, in the case where the internal diameter D35 of the third container segment 35 of the container main body 31 is made longer than the internal diameter D33, D34 of the first, second container segment 33, 34, in contrast to the case as indicated by the curve H1, even if the quantity of the developer contained in the container main body 31 is decreased, the quantity of developer discharge remains substantially invariant until the quantity of the developer becomes nearly zero. It follows from this that the developer container 30 in accordance with the embodiment is capable of performing developer discharge with stability for a longer period of time.

As described heretofore, according to the developer container 30 in accordance with the embodiment, by rotating the container main body 31 about the rotation axis L31, the developer contained therein is conveyed toward the discharge hole 43, and is then discharged therefrom into the first concavity 41. The part of the container main body 31 which includes at least the first and second concavities 41 and 42 and the discharge hole 43 is covered by the supporting member 32, from the outer side in the radial direction over the entire circumference. Therefore, the developer discharged from the discharge hole 43 into the first concavity 41 is retained in the first retaining space 62*a* facing the first concavity 41 and the inner periphery 48 of the supporting member 32. Moreover, the leading-out member 38 is loaded by the spring member 98 with a resilient force that tends to bring its upstream side end 38*b* in the rotation direction R into resilient contact with the surface of the bottom wall portion 41*b* of the first concavity 41 and the surface of the bottom wall portion 42*b* of the second concavity 42 of the container main body 31. As a result, as the container main body 31 is rotated about the rotation axis L31, the developer retained in the first and second retaining spaces 62*a* and 62*b* is scraped off the surface of the bottom wall portion 41*b* of the first concavity 41 and the surface of the bottom wall portion 42*b* of the second concavity 42, and is then directed to the leading through hole 51. The developer that thus reached the leading through hole 51 is then directed therefrom to the outside. Since the leading-out member 38 is shaped like a sheet, there is a possibility that it is plastically deformed when brought in contact with the outer peripheral surface of the container main body 31 rotating about the rotation axis L31. However, even though plastic deformation occurs, since the leading-out member 38 is loaded by the spring member 98 with a resilient force that tends to bring its upstream side end 38*b* in the rotation direction into resilient contact with the surface of the bottom wall portion 41*b* of the first concavity 41 and the surface of the bottom wall portion 42*b* of the second concavity 42 of the container main body 31, the upstream side end 38*b* in the rotation direction of the leading-out member 38 is allowed to abut resiliently against the surface of the bottom wall portion 41*b* of the first concavity 41 and the surface of the bottom wall portion 42*b* of the second concavity 42 of the container main body 31 without fail. Thereby, the developer retained in the first and second retaining spaces 62*a* and 62*b* is scraped off the surface of the bottom wall portion 41*b* of the first concavity 41 and the surface of the bottom wall portion 42*b* of the second concavity 42, and is then directed to the leading through hole 51.

According to the developer container 30 in accordance with the embodiment, the leading-out member 38 is flexible and resilient. The deformation preventive member 97 prevents plastic deformation of the midsection 38*c* of the leading-out member 38, which lies between both ends in the rotation direction R of the leading-out member 38. Thus, it never occurs that the midsection 38*c* lying between both ends in the rotation direction R of the leading-out member 38 is plastically deformed when brought in contact with the outer peripheral surface of the container main body 31 rotating about the rotation axis L31. Moreover, in the leading-out member 38, at least its upstream side end 38*b* in the rotation direction R is flexible and resilient. Thus, the upstream side end 38*b* in the rotation direction R of the leading-out member 38 is allowed to abut resiliently against the surface of the bottom wall portion 41*b* of the first concavity 41 and the surface of the bottom wall portion 42*b* of the second concavity 42 of the container main body 31 rotating about the rotation axis L31, throughout the area as seen in the direction of the rotation axis, under a uniform resilient force. Thereby, as the container main body 31 is rotated about the rotation axis L31, almost all of the developer retained in the first and second retaining spaces 62*a* and 62*b* of the container main body 31 is scraped off the surface of the bottom wall portion 41*b* of the first concavity 41 and the surface of the bottom wall portion 42*b* of the second concavity 42, and is then directed to the leading through hole 51.

According to the developer container 30 in accordance with the embodiment, the leading-out member 38 has the guide walls 99 which are formed at both axial ends thereof and protrude outward in the radial direction. This helps prevent the developer to be directed to the leading through hole 51 from being directed to any other position than the leading through hole 51. As a result, the developer can be directed to leading through hole 51 without fail.

According to the developer container 30 in accordance with the embodiment, by driving the container main body 31 to rotate about the rotation axis L31, the feeding means, disposed about the inner periphery of the container main body 31, acts to feed the developer contained in the container main body 31 in the axial direction. If the feeding means is, for example, like that of the related art practice, formed as a projection piece which protrudes inward in the radial direction or a groove which is sunk outward in the radial direction, which projection piece or groove extends in substantially a spiral fashion about the axis L31, the developer placed in the vicinity of the feeding means is kept in contact with the feeding means at all times, which may lead to coagulation of the developer in the vicinity of the feeding means. Furthermore, when an external force and shock such as torsion or bending is applied to the container main body, a crack may appear readily in the container main body and run along the feeding means in substantially a spiral fashion, resulting in the container main body suffering from breakage. To avoid this, in this embodiment, the feeding means has a plurality of first projection pieces 36 extending along the first extending direction and a plurality of second projection pieces 39 extending along the second extending direction. Since the first projection pieces 36 are spaced apart in the circumferential and axial directions, and so are the second projection pieces 39, the developer placed in the vicinity of the feeing means is alternately brought in and out of contact with the first and second projection pieces 36 and 39 over and over again during the rotation of the container main body 31. That is, the developer is not kept in contact with the feeding means all the time. Therefore, the developer can be prevented from being coagulated in the vicinity of the feeding means as certainly as possible. Moreover, since the first and second projection pieces 36 and 39 are spaced apart in the first and second extending directions, respectively, even if an external force and shock such as torsion or bending is applied to the container main body 31, it is possible to prevent a crack from readily appearing and running along the feeding means in substantially a spiral fashion, thereby protecting the container main body 31 from breakage as certainly as possible.

According to the developer container 30 in accordance with the embodiment, the container main body 31 can be rotated about the rotation axis L31, while being supported by the supporting member 32 with stability. In case where a cylindrical container, such as that which was practiced in the related art, now containing developer, is left stood up on a horizontal surface with its axis arranged perpendicular to the horizontal surface, the possibility arises that the developer particles contained in the lower part of the container will be coagulated. With this being the case, to prevent developer coagulation as certainly as possible, in case where the cylindrical container is stood up on the horizontal surface with its axis arranged parallel to the horizontal surface, the container may tumble down. According to the developer container 30 in accordance with the embodiment, by placing the supporting base 49 of the supporting member 32 on a horizontal surface, the container main body 31 can be stably placed with its axis L31 arranged parallel to the horizontal surface. In the event of the developer particles contained in the developer container 30 being partly coagulated, for example, a user drives the container main body 31 to rotate, with the shutter 65*a* of the shutter portion 65 arranged in the closing position P1. By doing so, the developer can be agitated and pulverized into fine particles with ease.

Moreover, the container main body 31 has, at its axial ends 33*a* and 34*a*, the faces 33*c* and 34*c*, respectively, each of which is defined by the juncture of the outer peripheral surface with the end face of its corresponding axial end. As described previously, since the faces 33*c* and 34*c* are each shaped as a curved plane gradually inclined inward in the radial direction, even if the user tries to stand the developer container 30 up on a horizontal surface, with one of the axial ends 33*a* and 34*a* of the container main body 31 placed on the horizontal surface and with the axis L31 arranged perpendicular to the horizontal surface, the developer container 30 may fall down. Hence, the user is not able to stand the developer container 30 up on a horizontal surface with the axis L31 arranged perpendicular to the horizontal surface. As a result, it is possible to eliminate one cause of coagulation of the developer contained in the container.

According to the developer container 30 in accordance with the embodiment, the supporting member 32 supports the part of the container main body 31 which includes at least the third container segment 35, from the outer side in the radial direction over the entire circumference. Moreover, as described previously, two pieces of sealing materials 47 are provided to achieve sealing between the container main body 31 and the supporting member 32. As a result, during the rotation of the container main body 31, it never occurs that the developer leaks from the region between the container main body 31 and the supporting member 32.

According to the developer container 30 in accordance with the embodiment, the quantity of developer discharge is dependent upon the capacity of the first retaining space 62*a* and the rotational speed of the container main body 31. In the developer container 30 in accordance with the embodiment, the number of concavities is two (the first and second concavities 41 and 42), and only the first concavity 41 is provided with the discharge hole 43. However, this does not suggest any limitation to the construction of the invention. For example, to increase the quantity of developer discharge per one rotation of the container main body 31, the second concavity 42 may have the same configuration as the first concavity 41 and also have the discharge hole 43. Alternatively, either concavity or discharge hole may be increased in number.

In this embodiment, the feeding means has the first projection piece 36 formed so as to extend along the first extending direction about the axis L31 and to protrude inward in the radial direction, and the second projection piece 39 formed so as to extend along the second extending direction about the axis L31 and to protrude inward in the radial direction. However, this does not suggest any limitation to the construction of the invention. For example, the feeding means may alternatively be provided with grooves formed so as to be sunk outward in the radial direction and to extend along the first (second) extending direction. Also in this case, the grooves are spaced apart in the circumferential and axial directions.

Moreover, the projection pieces 36 and 39 of the developer container 30 may alternatively be so designed that, among a plurality of projection pieces 36, 39, the ones formed close to the discharge hole 43 are each made larger in an amount jutting inward in the radial direction than the others formed far from the discharge hole 43. In this way, during the rotation of the container main body 31, the feeding amount of the developer close to the discharge hole 43 in the axial direction is larger than the feeding amount of the developer far from the discharge hole 43 in the axial direction. That is, the developer feeding amount is made nonuniform with respect to the axial direction. In a case where the developer feeding amount is made uniform with respect to the axial direction, in accompaniment with the rotation of the container main body 31, the developer contained in the container main body 31 is uniformly fed to the discharge hole. In this case, though low in possibility, the conveyed developer particles may be coagulated in the vicinity of the discharge hole 43. Since, in fact, only the developer close to the discharge hole 43 is fed directly to the discharge hole 43, by making the feeding amount of the developer close to the discharge hole 43 in the axial direction larger than the feeding amount of the developer far from the discharge hole 43 in the axial direction during the rotation of the container main body 31, it is possible to eliminate almost completely the possibility of coagulation of the conveyed developer in the vicinity of the discharge hole 43.

Figure 26:
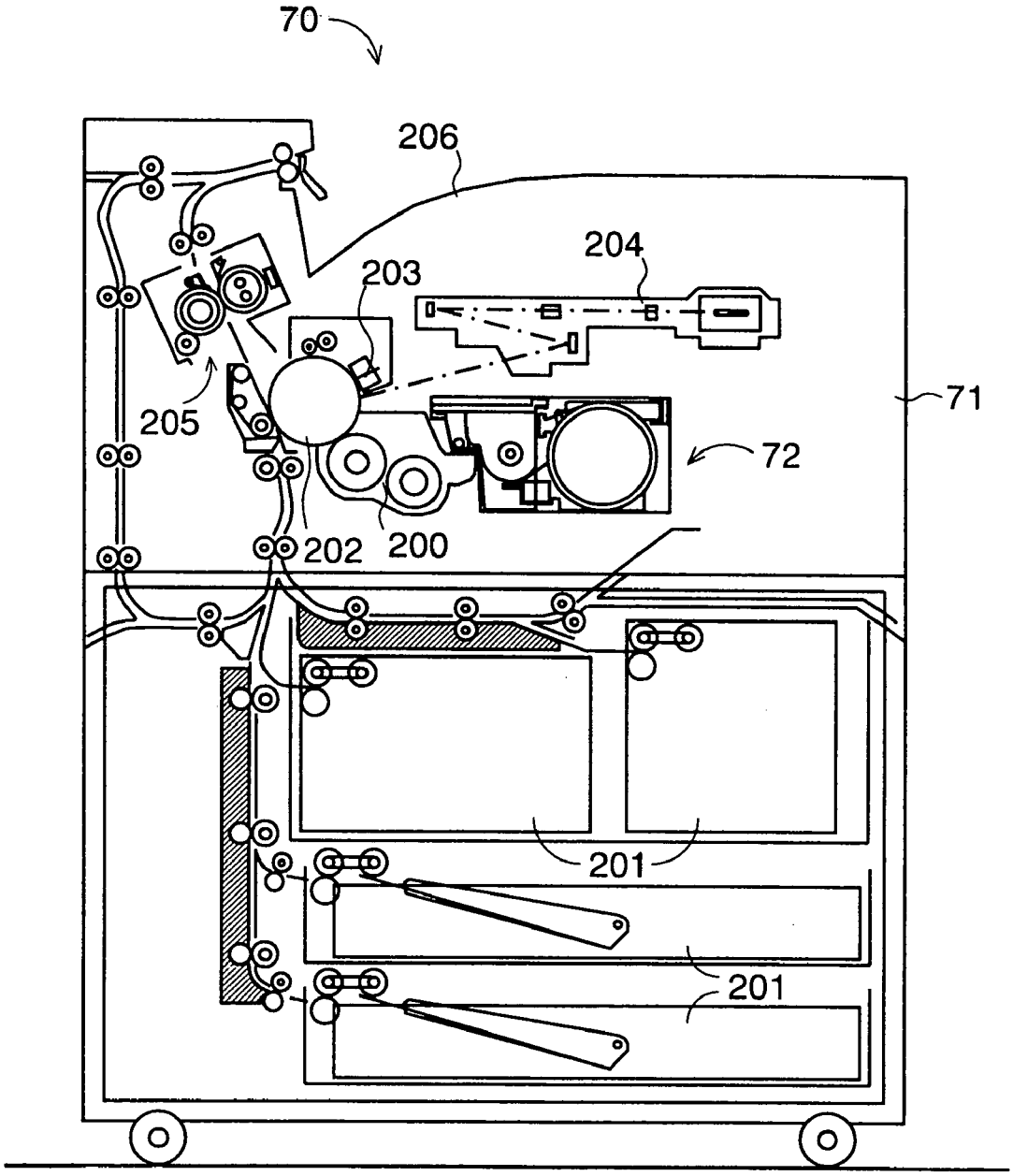
FIG. 26 is a sectional view showing an image forming apparatus according to another embodiment of the invention.
Figure 27:
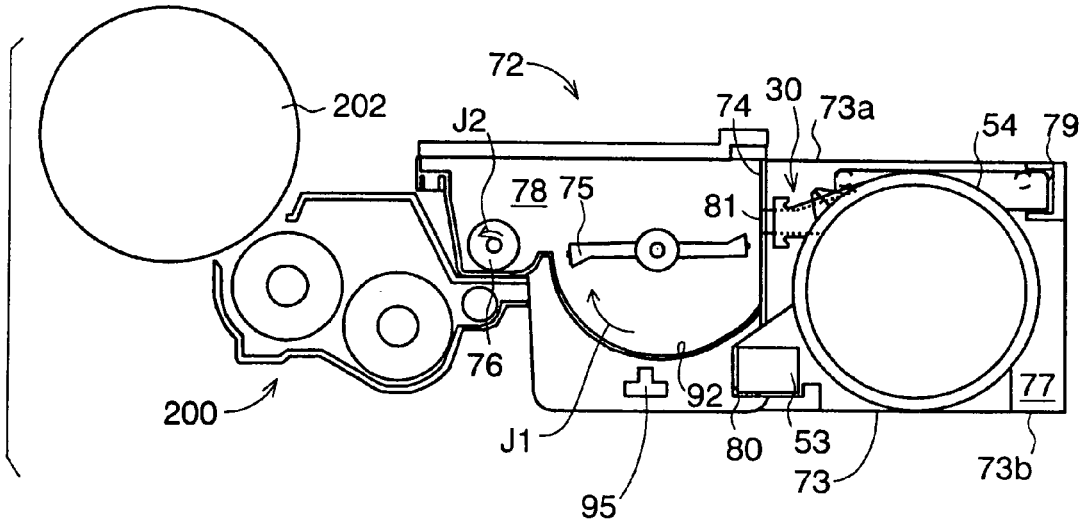
FIG. 27 is an enlarged sectional view showing a toner hopper and other components in the vicinity.
Figure 28:
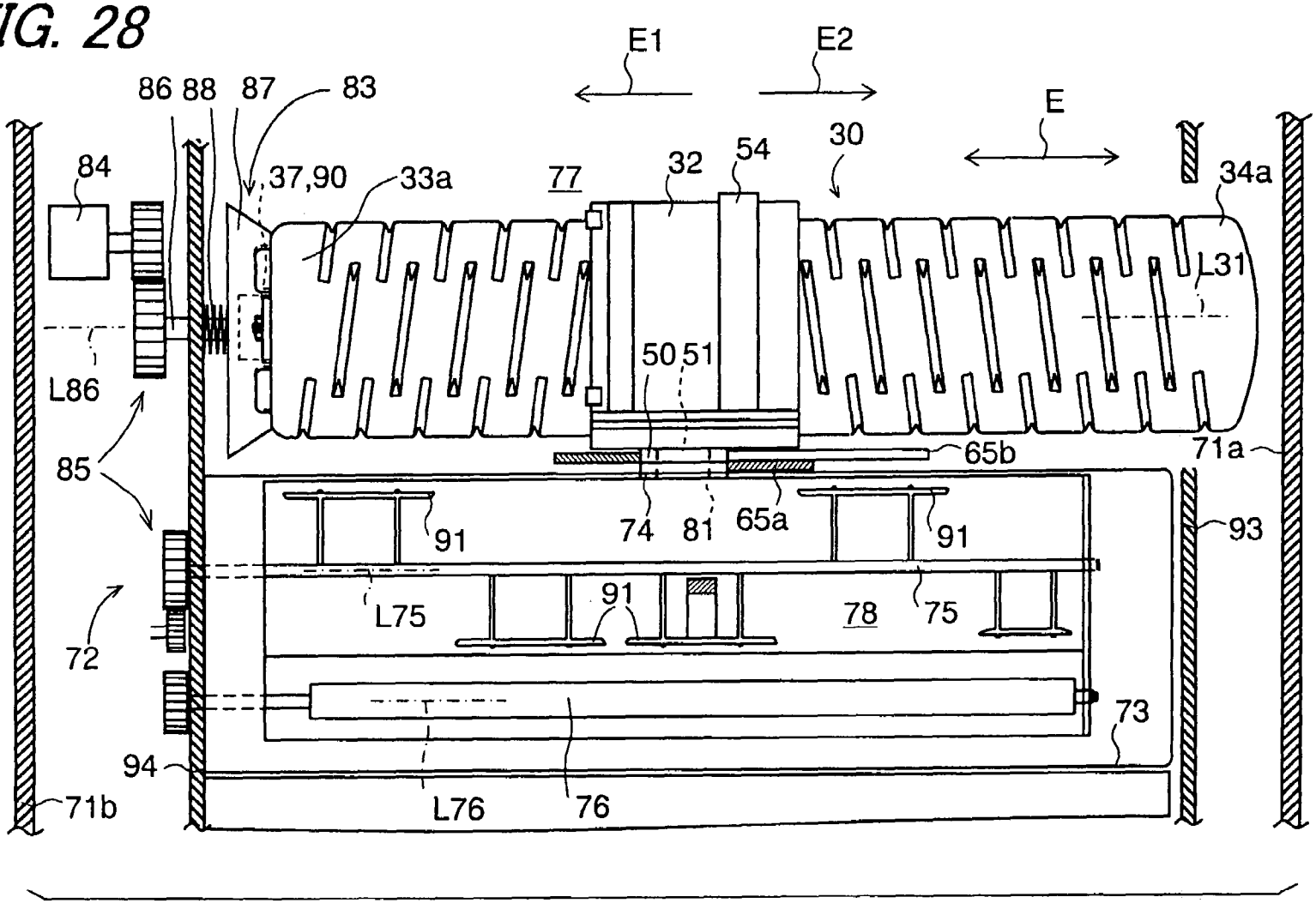
FIG. 28 is an enlarged plan view showing the toner hopper and other components in the vicinity.

FIG. 26 is a sectional view showing an image forming apparatus 70 according to another embodiment of the invention. FIG. 27 is an enlarged sectional view showing a toner hopper 72 and other components in the vicinity. FIG. 28 is an enlarged plan view showing the toner hopper 72 and other components in the vicinity. FIG. 26 is a sectional view showing the image forming apparatus 70, as seen from its front-side exterior portion 71*a*. In the figure, the thickness of the construction is omitted in the interest of understanding of the invention. The front-side exterior portion 71*a* refers to one part of the image forming apparatus 70 with which the user normally faces during its use. On the other hand, a back-side exterior portion 71*b* refers to another part of the image forming apparatus 70 reverse to the front-side exterior portion 71*a* by which the user is present. Here, the image forming apparatus 70 is assumed to be placed on a horizontal surface, and a direction from the front-side exterior portion 71*a* to the back-side exterior portion 71*b*, which is defined as a "front-to-back direction E", is arranged parallel to the horizontal surface.

The electrophotographic image forming apparatus 70, built as a printer, a copier, or the like, includes the developer container 30 explained hereinabove and an image forming apparatus main body (hereafter also referred to simply as an "apparatus main body") 71. The developer container 30 is detachably and attachably mounted in a toner hopper 72 disposed in the apparatus main body 71 through a container attachment port (not shown) disposed openably and closably in the front-side exterior portion 71*a* of the apparatus main body 71. Moreover, in the image forming apparatus main body 71 are provided a cabinet front portion 93 which is disposed in a position on the backside exterior portion 71*b* side as compared to the front-side exterior portion 71*a*, and an opening which is pierced along a thickness direction and can insert developer container 30. Further, the image forming apparatus main body 71 has a cabinet back portion 94 which is disposed in a position on the front-side exterior portion 71*a* side as compared to the back-side exterior portion 71*b*. The cabinet body (its entirety is not shown) including the cabinet front portion 93 and the cabinet back portion 94 holds the constituent components of the image forming apparatus main body 71.

The toner hopper 72 includes a housing 73, a developer supply section 74, an agitation member 75, and a supply roller 76. The space inside the housing 73 is separated by the developer supply section 74 into at least a container housing space 77 and an agitation space 78. The container housing space 77 is opened so as to face the front-side exterior portion 71*a* of the apparatus main body 71. The agitation space 78 is kept in substantially a closed state. The developer container 30 is arranged within the container housing space 77.

On an upper wall portion 73*a* of the housing 73 facing the container housing space 77 is formed a first guide concavity 79 extending along the front-to-back direction E of the apparatus main body 71, in which the first guide piece 53 of the supporting member 32 of the developer container 30 is receivable. The first guide concavity 79 is so designed that the first guide piece 53 of the supporting member 32 of the developer container 30 is fitted therein so as to be slidable in its lengthwise direction, namely, either in an attachment direction E1 (direction from the front-side exterior portion 71*a* to the back-side exterior portion 71*b*) or in a detachment direction E2 opposite thereto, both of which are parallel to the front-to-back direction E of the apparatus main body 71. Moreover, on a lower wall portion 73*b* of the housing 73 opposed to the upper wall portion 73*a* facing the container housing space 77 is formed a second guide concavity 80 extending along the front-to-back direction E of the apparatus main body 71, in which the second guide piece 54 of the supporting member 32 of the developer container 30 is receivable. The second guide concavity 80 is so designed that the second guide piece 54 of the supporting member 32 of the developer container 30 is fitted therein so as to be slidable in its longitudinal direction, namely, either in the attachment direction E1 or in the detachment direction E2 of the apparatus main body 71.

The developer supply section 74 is constituted by a platy member to separate the space inside the housing 73 into the container housing space 77 and the agitation space 78. The developer supply section 74 has a communication hole 81 pierced all the way through its thickness direction, for providing communication between the container housing space 77 and the agitation space 78. Below the communication hole 81 of the developer supply section 74 is disposed a guide member protruding into the container housing space 77.

Figure 29:
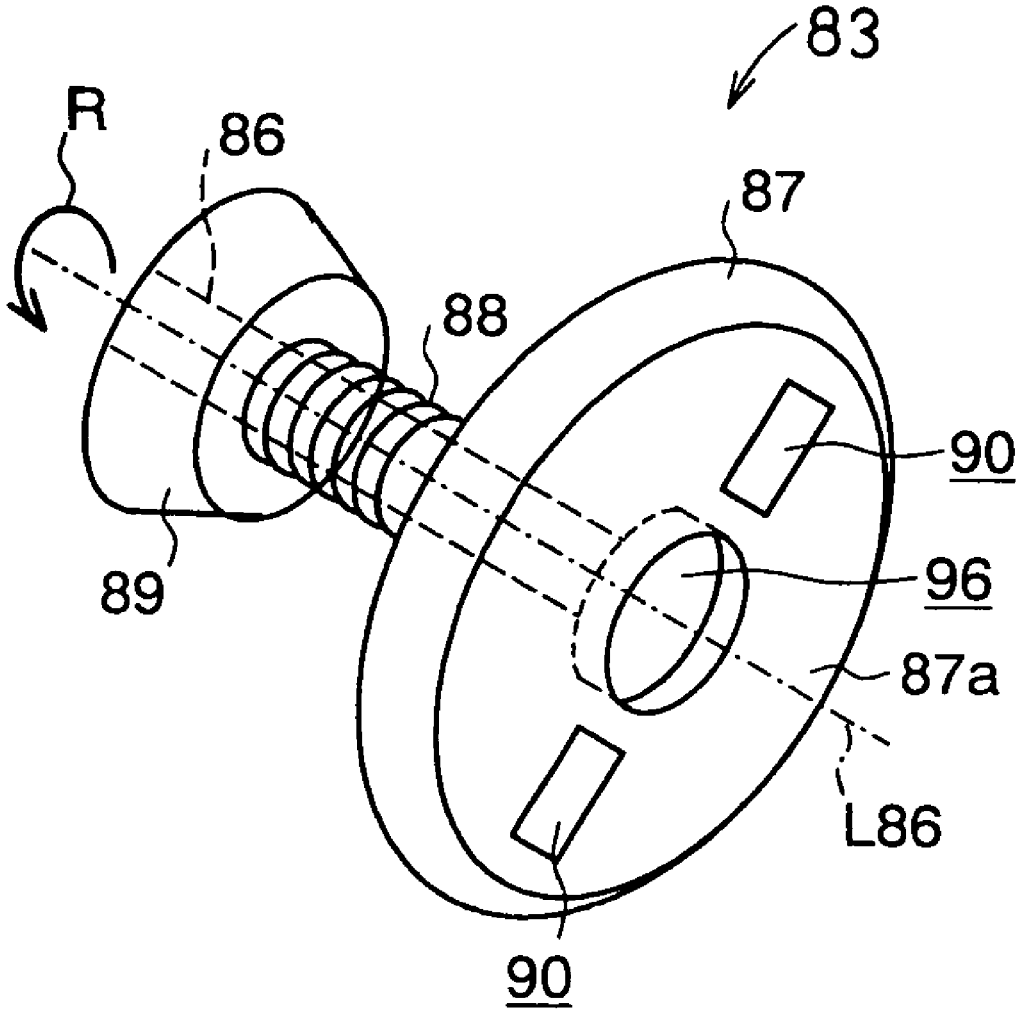
FIG. 29 is an enlarged perspective view showing a main body-side coupling section.
Figure 30:
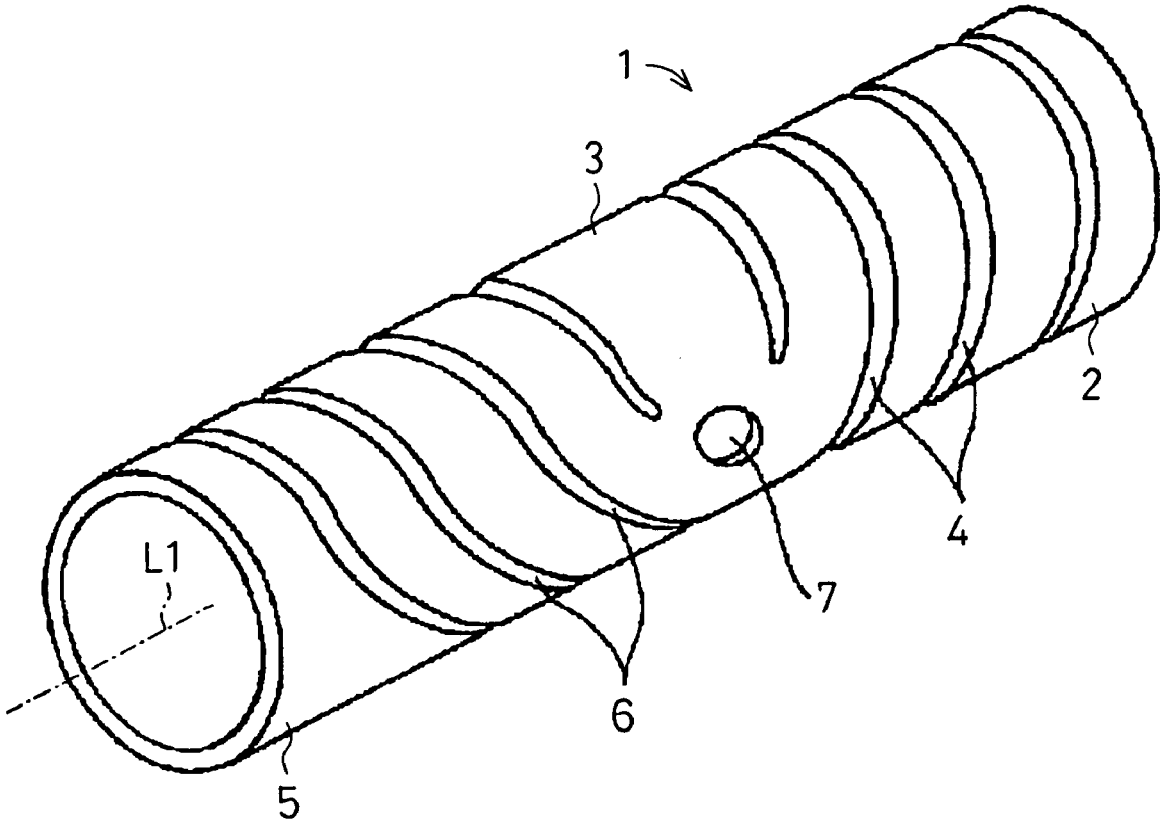
FIG. 30 PRIOR ART
FIGS. 30 is a perspective view showing the developer supply container following the first related art.
Figure 31:
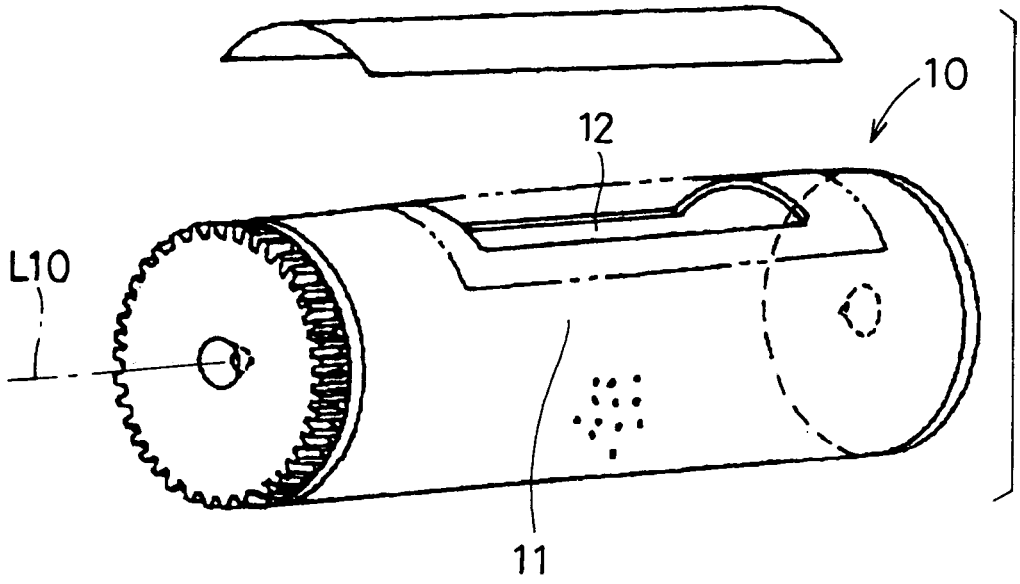
FIG. 31 PRIOR ART
FIG. 31 is a perspective view showing the toner cartridge following the second related art.

FIG. 29 is an enlarged perspective view showing the main body-side coupling section 83. A driving force for rotating the container main body 31 of the developer container 30 is produced from a driving source 84, such as a motor, of the apparatus main body 71. The driving force is transmitted through a reduction device 85, such as a reduction gear, to the main body-side coupling section 83. The main body-side coupling section 83, the driving source 84, and the reduction device 85 constitute driving means. The main body-side coupling section 83 includes a rotation shaft 86, a coupling support 87, and a spring member 88. The rotation shaft 86 is mounted rotatably in a bearing 89, with its axis L86 arranged parallel to the front-to-back direction E of the apparatus main body 71 and with its free end placed within the container housing space 77. The bearing 89 is pierced through the cabinet back portion 94 back to back with part of the housing 73 on the side of the back-side exterior portion 71*b* of the apparatus main body 71.

The coupling support 87, which is formed in substantially a disc shape, is arranged so as to face the container housing space 77. The coupling support 87 is made rotatable about the axis L86 integrally with the rotation shaft 86, and is coupled to the free end of the rotation shaft 86. The coupling support 87 has, at the center of its surface 87*a* reverse to another surface facing with the cabinet back portion 94, an auxiliary concavity 96 formed so as to be sunk toward the cabinet back portion 94, the axis of which coincides with the axis L86 of the rotation shaft 86. In the auxiliary concavity 96 is receivable the replenishment port 45 to which the replenishment lid 46 is attached in the developer container 30. The coupling support 87 also has, at the outer side in the radial direction of the auxiliary concavity 96 on its surface 87*a*, a plurality (two pieces, in this embodiment) of concave fits 90 formed so as to be sunk toward the cabinet back portion 94. The concave fits 90 are arranged symmetrically with each other with respect to the axis L86 of the rotation shaft 86. Each of the concave fits 90 is configured in accordance with the shape of its corresponding convex fit 37 of the container main body 31. The convex fit 37 of the container main body 31 is fitted into the concave fit 90, thus achieving engagement therebetween.

Moreover, the coupling support 87 is made displaceable about the axis of the rotation shaft 86 without falling off from the free end of the rotation shaft 86. The spring member 88, realized by the use of a coil compression spring or the like, is arranged between the cabinet back portion 94 and the coupling support 87. The spring member 88 loads the coupling support 87 with a resilient force that tends to pull it away from the cabinet back portion 94 without hindering the rotation of the rotation shaft 86 and the coupling support 87. A combination of one axial end 33*a* including the convex fit 37 of the container main body 31 of the developer container 30 and the coupling support 87 of the main body-side coupling section 83 constitutes a coupling structure. Thus, the convex fit 37 of the container main body 31 is detachably and attachably coupled to the coupling support 87 of the main body-side coupling section 83.

The developer container 30 is attached to the apparatus main body 71 in the following manner. At first, the developer container 30 is inserted, from the front-side exterior portion 71*a* of the apparatus main body 71, into the container housing space 77 of the toner hopper 72, with its rotation axis L31 arranged parallel to the attachment direction E1. At this time, the first guide piece 53 of the supporting member 32 of the developer container 30 is fitted into the first guide concavity 79 of the housing 73, and concurrently the second guide piece 54 of the supporting member 32 is fitted into the second guide concavity 80 of the housing 73. This helps prevent displacement of the supporting member 32 in any other direction than the attachment and detachment directions E1 and E2. In this state, the developer container 30 is displaced in the attachment direction E1 until it reaches an attachment position at which the leading through hole 51 of the discharge section 50 of the supporting member 32 communicates with the communication hole 81 of the developer supply section 74. At this time, the coupling support 87 of the main body-side coupling section 83 is pressed by the convex fit 37 of the container main body 31 to recede contractedly in the attachment direction E1, and the spring member 88 is accordingly compressed.

The toner hopper 72 is provided with a regulatory member (not shown) for, while the developer container 30 is being kept at the attachment position, restraining displacement of the supporting member 32 in the attachment and detachment directions E1 and E2, and releasing the restraint. When the developer contained in the developer container 30 is discharged completely, the user is able to release the restraint put on the supporting member 32 by the regulatory member so as for the developer container 30 to be displaced in the detachment direction E2. In this way, the developer container 30 is detached from the apparatus main body 71.

Moreover, shutter displacement means (not shown) is additionally disposed around the communication hole 81, facing with the container housing space 77, of the developer supply section 74 of the toner hopper 72, for slidingly displacing the shutter 65*a* of the shutter portion 65 of the developer container 30. In order for the developer container 30 to be attached, the developer container 30 is inserted, from the front-side exterior portion 71*a* of the apparatus main body 71, into the container housing space 77 of the toner hopper 72, with its rotation axis L31 arranged parallel to the attachment direction E1. At this time, the shutter 65*a* is slidingly displaced from the closing position P1 in one second horizontal direction B1 by the shutter displacement means. Upon the developer container 30 reaching the attachment position, the shutter 65*a* is arranged at the opening position P2. On the other hand, in order for the developer container 30 to be detached from the apparatus main body 71, the developer container 30 is displaced from the attachment position in the detachment direction E2. At this time, the shutter 65*a* is slidingly displaced from the opening position P2 in the other second horizontal direction B2 by the shutter displacement means to the closing position P1.

Further, a sealing material (not shown) is additionally disposed at least either around the leading through hole 51 of the discharge section 50 of the supporting member 32 of the developer container 30, or around the communication hole 81, facing the container housing space 77, of the developer supply section 74 of the toner hopper 72. By dint of the sealing material, the developer flowing down from the leading through hole 51 to the communication hole 81 can be prevented from finding its way toward any area other than the agitation space 78.

The apparatus main body 71 includes a development section 200 and a photoconductive drum 202. As shown in FIG. 28, the development section 200 is arranged in the middle of the apparatus main body 71 as seen in the front-to-back direction E. This is because the photoconductive drum 202 is arranged in the middle of the apparatus main body 71 as seen in the front-to-back direction E. Moreover, the main body-side coupling section 83, as well as the driving section including the driving source 84 and the reduction device 85 for rotating the agitation member 75 and the supply roller 76, is arranged between the cabinet back portion 94 and the back-side exterior portion 71*b* in the apparatus main body 71. Accordingly, in the state where the developer container 30 is arranged at the attachment position, the supporting member 32 of the developer container 30 is arranged in the middle of the apparatus main body 71 as seen in the front-to-back direction E. As described previously, in the developer container 30, the container main body 31 is so designed that its one length measurement from the supporting member 32 to the end face of one axial end 33*a* having the convex fit 37 is made shorter than the other length measurement from the supporting member 32 to the end face of the other axial end 34*a*.

According to the image forming apparatus 70 in accordance with the embodiment, in the developer container 30, the supporting member 32 is arranged in the axially middle position of the container main body 31. Accordingly, in the state where the developer container 30 is arranged at the attachment position in the image forming apparatus main body 71, the supporting member 32 is arranged in the middle of the apparatus main body 71 as seen in the front-to-back direction E. With this arrangement, in the apparatus main body 71, the container main body 31 can be elongated from a middle position in the front-to-back direction E to the front side, and concurrently elongated from the middle position in the front-to-back direction E to the back side, resulting in an advantage in increasing the capacity significantly. In this embodiment, as shown in FIG. 28, the other axial end 34*a* of the developer container 30 juts out closer to the front-side exterior portion 71*a* than the cabinet front portion 93.

Moreover, in the container main body 31, by making one length measurement from the supporting member 32 to the end face of one axial end 33*a* shorter than the other length measurement from the supporting member 32 to the end face of the other axial end 34*a*, it is possible to secure, in the back side of the apparatus main body 71, a certain region for disposing the driving section including the driving source 84 and the reduction device 85 to be coupled to the convex fit 37 of one axial end 33*a* of the container main body 31. It follows, therefore, that the developer container 30 has succeeded in offering two unique effects: the space inside the apparatus main body 71 is utilized effectively while increasing the developer-containing capacity as much as possible.

With the developer container 30 kept arranged at the attachment position, the driving source 84 is activated to rotate the coupling support 87. At this time, when the concave fit 90 of the coupling support 87 is kept in engagement with the convex fit 37 of the developer container 30, the container main body 31 is allowed to rotate about the rotation axis L31. By contrast, when the concave fit 90 of the coupling support 87 is kept out of engagement with the convex fit 37 of the developer container 30, only the coupling support 87 is subjected to angular displacement, for a while, until the engagement between the concave fit 90 of the coupling support 87 and the convex fit 37 of the developer container 30 is completed. Upon completion of the engagement between the concave fit 90 of the coupling support 87 and the convex fit 37 of the developer container 30, the spring member 88 exerts a resilient force to make the engagement therebetween tighter. Then, the container main body 31 is allowed to rotate about the rotation axis L31. As the container main body 31 of the developer container 30 is rotated about the rotation axis L31, the developer contained in the developer container 30 is supplied, through the leading through hole 51 of the discharge section 50 of the supporting member 32 and the communication hole 81 of the developer supply section 74 of the toner hopper 72, into the agitation space 78 and is stored therein.

The agitation member 75 and the supply roller 76, each extending in the front-to-back direction E of the apparatus main body 71, are arranged within the agitation space 78, with a certain interval secured therebetween. The agitation member 75 is made rotatable about an agitation axis L75 parallel to the front-to-back direction E, and has a flexible scraper member 91 extending in the direction of the agitation axis L75. Moreover, the agitation member 75 is rotated about the agitation axis L75 in a clockwise direction J1, looking from the front of the apparatus main body 71, under the driving force exerted by the driving source 84 disposed in the apparatus main body 71. The supply roller 76 is made rotatable about a supply axis L76 parallel to the front-to-back direction E. The outer peripheral surface of the supply roller 76 is made of a porous resin material such as a sponge. Moreover, the supply roller 76 is rotated about the supply axis L76 in a counterclockwise direction J2, looking from the front of the apparatus main body 71, under the driving force exerted by the driving source 84 disposed in the apparatus main body 71.

The toner hopper 72 is additionally provided with an agitation wall portion 92 arranged so as to face the agitation space 78. The agitation wall portion 92 is so formed as to communicate with the developer supply section 74, and to extend in the front-to-back direction E of the apparatus main body 71. The agitation wall portion 92 has a cross section formed in a U-like shape, as seen in a direction perpendicular to the agitation axis L75 of the agitation member 75. The agitation wall portion 92 is opened upwardly and thus has a part-cylindrical inner peripheral surface. Although the developer is supplied through a single communication hole 81 alone into the agitation space 78, as described previously, since the developer discharged from the developer container 30 is excellent in flowability because of not only the agitation effect but also the mixing of gas into its fine particles, the developer passing through the communication hole 81 can be diffused satisfactorily in the direction of the agitation axis L75 within the agitation space 78. The developer supplied to the agitation space 78 is further diffused in the direction of the agitation axis L75 in the agitation space 78 through agitation carried out by the agitation member 75.

As the agitation member 75 is rotated, the developer having been supplied through the communication hole 81, now contained in the agitation space 78, is agitated thereby. Simultaneously, the scraper member 91 scrapes up the developer contained in the agitation space 78, with its free end kept in abutment with the agitation wall portion 92, to apply fine powdery developer particles substantially evenly to the surface of the supply roller 76 in the direction of its axis L76. Even when the agitation space 78 has only a small quantity of developer left, the residual developer is scraped up by the scraper member 91 and is then fed to the supply roller 76 properly, resulting in an advantage in minimizing the quantity of the developer that remains in the agitation space 78 unsupplied to the supply roller 76. The developer given to the supply roller 76 is then fed to the development section 200, in good condition, in accompaniment with its rotation.

The apparatus main body 71 further includes, in addition to the development section 200 and the photoconductive drum 202, a recording sheet cassette 201, a charging section 203, a laser exposure section 204, and a fixating section 205. In the development section 200, the toner, i.e., the developer supplied from the toner hopper 72 and magnetic carrier particles prepared beforehand are agitated together to produce dual-component developer.

The recording sheet cassette 201 accommodates recording sheets for use in image formation. The photoconductive drum 202, which is composed of a cylindrical drum having a photosensitive element formed about its outer periphery, is rotated about its axis under the driving force exerted by the driving section. The charging section 203 applies electric charge to the photosensitive element of the photoconductive drum 202 to achieve photosensitization. In the laser exposure section 204, the photosensitive element of the photoconductive drum 202 bearing electrical charge is exposed to laser light to form an electrostatic latent image on the photosensitive element.

In the development section 200, the dual-component developer is agitated and is then fed to the photosensitive element of the photoconductive drum 202 on which an electrostatic latent image is formed, so that the electrostatic latent image is developed as a toner image. The photoconductive drum 202 transfers the toner image carried on the photoconductive drum 202 onto a recording sheet provided from the recording sheet cassette 201. In the fixating section 205, the toner image transferred onto the recording sheet is fixated. The recording sheet carrying the toner image fixated thereon is discharged onto a discharge tray 206. In order to keep the toner concentration of the dual-component developer constant in the development section 200, the supply roller 76 has its outer periphery made of a sponge, and its rotation is controlled properly. In this way, the supply roller 76 supplies a proper quantity of toner in fine powder form to the development section 200.

Hereinafter, a brief explanation will be given as to the control of the container main body 31 of the developer container 30, and the agitation member 75 and the supply roller 76 of the toner hopper 72. A toner remaining quantity detector 95 is disposed in the agitation wall portion 92. When the toner remaining quantity detector 95 detects a reduction in the quantity of the developer (hereafter also referred to as the "toner") contained in the agitation space 78 of the toner hopper 72, a non-illustrated control section controls the driving source 84 to rotate the container main body 31 of the developer container 30. Thereby, the toner is fed into the agitation space 78. When it is detected by the toner remaining quantity detector 95 that the agitation space 78 is not full of the toner in spite that the container main body 31 has been rotated for a predetermined period of time, the control section brings the rotation of the container main body 31 to a halt, and concurrently displays a message on a non-illustrated display section to notify the user to replace the developer container 30. As of this point in time, in fact, some quantity of the developer is contained in the agitation space 78 of the toner hopper 72. While the developer is still present in the agitation space 78 of the toner hopper 72, the user is able to detach the empty developer container 30 from the apparatus main body 71, and then attach a new developer container 30 containing developer to the apparatus main body 71. Thus, even while the image forming apparatus 70 is in the midst of forming an image on a recording sheet, since the developer required for completing the image formation is still contained in the agitation space 78 of the toner hopper 72, it is possible to replenish the apparatus main body 71 with developer without interrupting the image forming operations.

In this embodiment, developer replenishment can be effected simply by replacing the developer container 30 with a new one. For example, all that needs to be done by the user is simply to grasp the supporting member 32 and the second container segment 34 of the developer container 30, and then insert the developer container 30, the first container segment 33 having the convex fit 37 first, through the cabinet front portion 93 of the apparatus main body 71, into the container housing space 77 of the toner hopper 72 in the attachment direction E1. On the other hand, to detach the developer container 30 from the apparatus main body 71, what remains to be done by the user is simply to grasp the second container segment 34 of the developer container 30, and then pull it out in the detachment direction E2. Quite understandably, this is very user-friendly.

In order to prevent coagulation of contained developer through agitation, users have hitherto had to shake a large-size, heavy toner cartridge upward, downward, rightward, and leftward. However, in the developer container 30 in accordance with the embodiment, developer coagulation can be prevented simply by rotating the container main body 31 about the rotation axis L31. This is very user-friendly. Moreover, in the developer container 30 in accordance with the embodiment, the mechanism for agitating the developer contained therein is quite simple. Further, in the developer container 30, sealing is achieved between the container main body 31 and the supporting member 32. While the developer container 30 is kept at the attachment position in the apparatus main body 71, sealing is effected at least either around the leading through hole 51 of the discharge section 50, or around the communication hole 81 of the developer supply section 74, the leading through hole 51 and the communication hole 81 communicating with each other. With this sealing effect, developer leakage can be prevented in the container housing space 77 of the toner hopper 72 as reliably as possible. This helps keep the user's hands free of a developer smear as reliably as possible during the replacement of the developer container 30. In addition, being substantially cylindrical-shaped, the developer container 30 can be housed in a slim, rectangular-parallelepiped package. This helps facilitate transportation and interpolation.

Another advantageous feature is that, as described previously, the developer container 30 requires less force to rotate the container main body 31 while keeping the quantity of developer discharge per one rotation of the container main body 31 as constant as possible. This does away with the need to increase the rotational speed of the container main body 31. That is, developer can properly be fed into the agitation space 78 of the toner hopper 72 at a lower rotational speed. As a result, it is possible to feed developer into the agitation space 78 while keeping the quantity of developer discharge per one rotation of the container main body 31 as constant as possible. This leads to a reduction in torque in the driving source 84, whereby making it possible to realize the driving source 84 by the use of a compact motor.

Note that, although the above description deals with the case where the developer container 30 and the image forming apparatus 70 in accordance with the embodiment is applied to a development system employing dual-component developer, the invention is applicable also to a development system employing toner alone.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developer container designed to be detachably and attachably mounted in an image forming apparatus, comprising:

a container main body, formed in a cylindrical shape, for containing therein developer for use in image formation, the container main body having, about its outer periphery, a concavity which is sunk inward in a radial direction and a discharge hole for discharging developer into the concavity, the container main body being rotated about its axis to convey the developer contained therein toward the discharge hole;

a supporting member for supporting the container main body rotatably about its axis by covering a part of the container main body which part includes at least the concavity and the discharge hole, from its outer side in the radial direction over its entire circumference, the supporting member having a leading through hole formed so as to face a path along which the concavity is moved in accompaniment with a rotation of the container main body, for leading the developer discharged from the discharge hole to outside;

a leading-out member, formed in a sheet-like shape and extending from the leading through hole on an upstream side in a rotation direction, for leading the developer discharged from the discharge hole of the container main body to the leading through hole; and resilient-force generating means for loading the leading-out member with a resilient force that tends to bring an upstream side end in the rotation direction of the leading-out member into resilient contact with an outer peripheral surface of the concavity in the container main body.

2. The developer container of claim 1, wherein the upstream side end in the rotation direction of the leading-out member is flexible and resilient.

3. The developer container of claim 1, further comprising a deformation preventive member for preventing plastic deformation of a midsection of the leading-out member, the midsection lying between both ends in the rotation direction of the leading-out member, wherein the leading-out member is flexible and resilient.

4. The developer container of claim 1, wherein the leading-out member has guide walls which are formed at both axial ends thereof and protrude outward in the radial direction.

5. An image forming apparatus in which the developer container of claim 1 is detachably and attachably mounted.

* * * * *